US008850763B2

(12) United States Patent
Marsh et al.

(10) Patent No.: US 8,850,763 B2
(45) Date of Patent: Oct. 7, 2014

(54) SUPER UNITIZED POST TENSION BLOCK SYSTEM FOR HIGH HIGH STRENGTH MASONRY STRUCTURES—WITH SUPERSTRONGBLOKS

(76) Inventors: Roger F. Marsh, Alexandria, IN (US); Patricia M. Marsh, Alexandria, IN (US)

( * ) Notice: Subject to any disclaimer, the term of this patent is extended or adjusted under 35 U.S.C. 154(b) by 0 days.

(21) Appl. No.: 11/977,470

(22) Filed: Oct. 25, 2007

(65) Prior Publication Data

US 2008/0098687 A1 May 1, 2008

Related U.S. Application Data

(60) Provisional application No. 60/854,913, filed on Oct. 27, 2006, provisional application No. 60/925,302, filed on Apr. 19, 2007.

(51) Int. Cl.
*E04C 5/08* (2006.01)

(52) U.S. Cl.
USPC ..... 52/223.7; 52/293.2

(58) Field of Classification Search
USPC ..... 52/223.7, 293.2, 594, 565, 740.1
See application file for complete search history.

(56) References Cited

U.S. PATENT DOCUMENTS

| | | | | | |
|---|---|---|---|---|---|
| 952,305 | A * | 3/1910 | Buskirk | 52/564 |
| 962,463 | A * | 6/1910 | Phillips | 52/410 |
| 1,753,451 | A * | 4/1930 | Tonnelier | 52/564 |
| 1,892,605 | A * | 12/1932 | Betzler | 52/293.2 |
| 2,963,828 | A * | 12/1960 | Belliveau | 52/564 |
| 3,296,758 | A * | 1/1967 | Knudsen | 52/223.7 |
| 3,763,609 | A * | 10/1973 | Probst | 52/105 |
| 4,640,071 | A | 2/1987 | Haener | |
| 5,511,902 | A | 8/1996 | Center | |
| 5,809,732 | A | 9/1998 | Farmer, Sr. et al. | |
| 5,950,319 | A * | 9/1999 | Harris | 33/494 |
| 6,098,357 | A | 8/2000 | Franklin et al. | |
| 6,167,669 | B1 * | 1/2001 | Lanc | 52/426 |
| 6,178,714 | B1 | 1/2001 | Carney, Jr. | |
| 6,244,785 | B1 | 6/2001 | Richter et al. | |
| 6,427,390 | B1 * | 8/2002 | Thies | 52/58 |
| 6,691,471 | B2 | 2/2004 | Price | |
| 6,915,614 | B2 * | 7/2005 | Matsufuji | 52/600 |
| 2004/0020145 | A1 | 2/2004 | Matsufuji | |
| 2006/0168906 | A1 * | 8/2006 | Tonyan et al. | 52/264 |
| 2007/0017176 | A1 * | 1/2007 | Gray | 52/605 |
| 2007/0107333 | A1 | 5/2007 | Marsh | |
| 2007/0186502 | A1 | 8/2007 | Marsh | |

* cited by examiner

*Primary Examiner* — Branon Painter
(74) *Attorney, Agent, or Firm* — Brannon Sowers & Cracraft

(57) ABSTRACT

An improved, high strength construction system that uses post tensioning. It is comprised of a series of interconnected, super heavy duty hollow core blocks 102 with minimal ducts 103, a series of tendons 105, and a plurality of anchors or plates 104 with additional features. The system 101 is configured with the plurality of adjacent blocks 102 contiguous and touching one another and demountably coupled to each other by means of the tendons 105 and anchors 103. The unique features include a strong, durable full plate 104 and bolt 105 both of which may be treated for corrosion resistance. This new coupling results in a structure that is far stronger than an ordinary block structure built with mortar and standard reinforcing. The SYSTEM has more predictable and controlled strength which is stronger than most reinforced concrete systems.

2 Claims, 17 Drawing Sheets

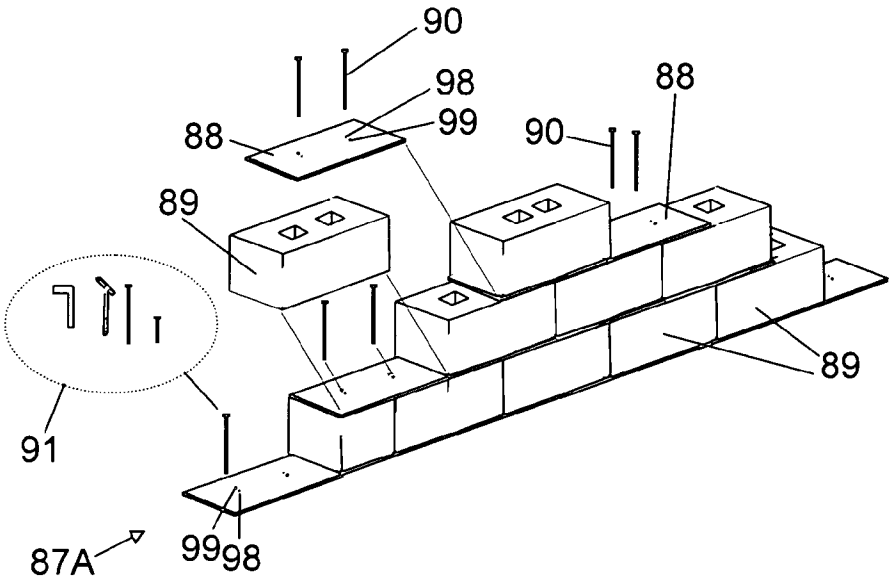
Fig. 3 C
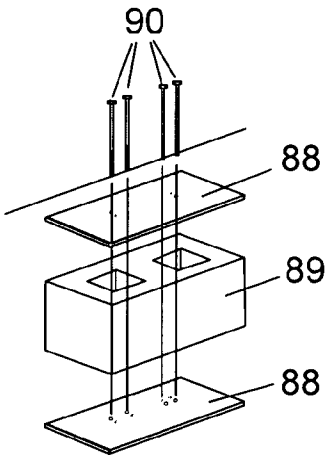
Fig. 3 B
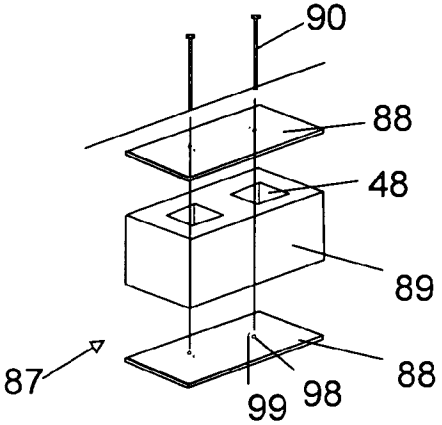
Fig. 3 A
Fig. 3

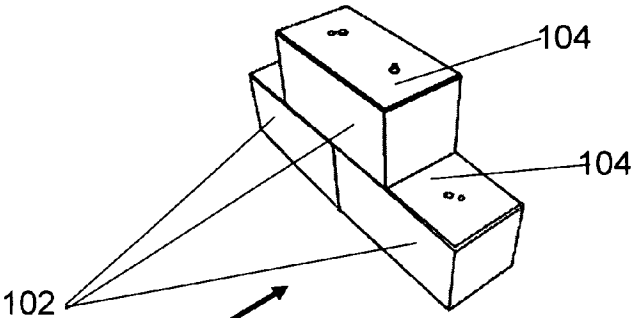
Fig. 6 C
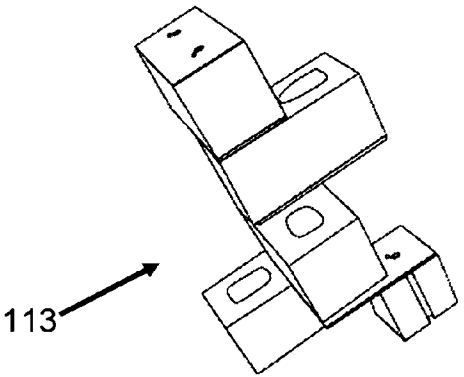
Fig. 6 D
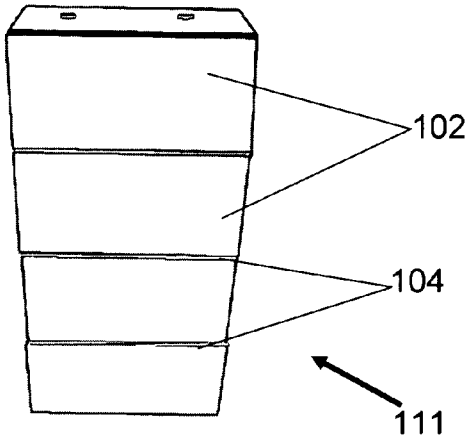
Fig. 6 A
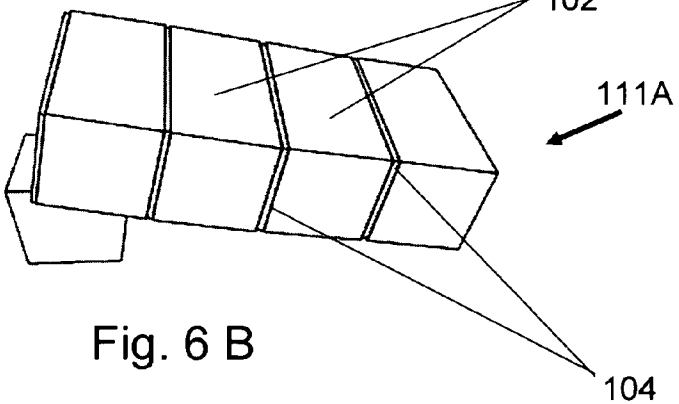
Fig. 6 B
Fig. 6

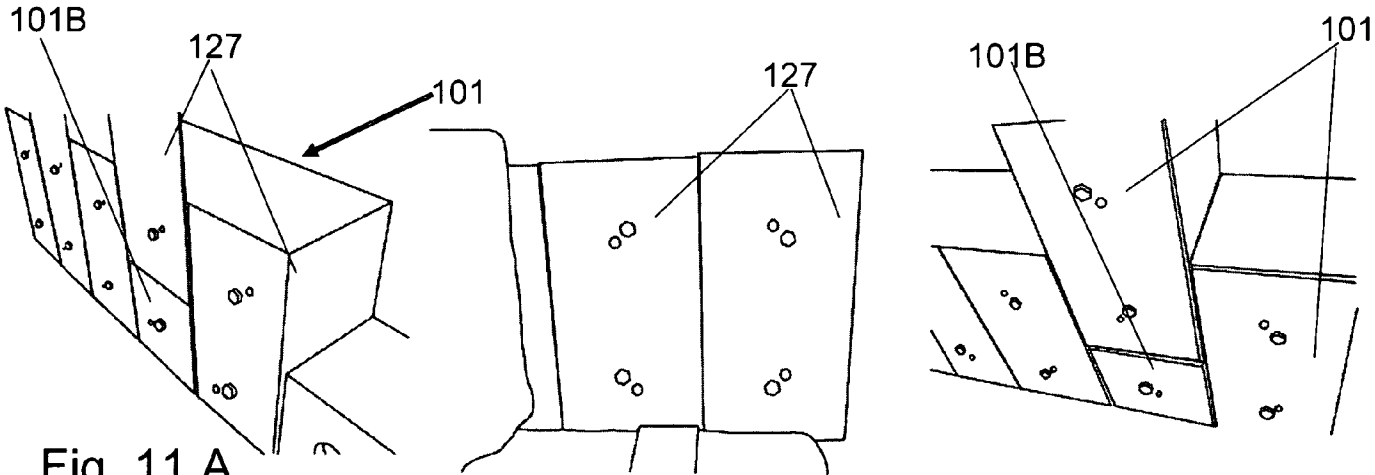
Fig. 11 A
Fig. 11 B
Fig. 11 C
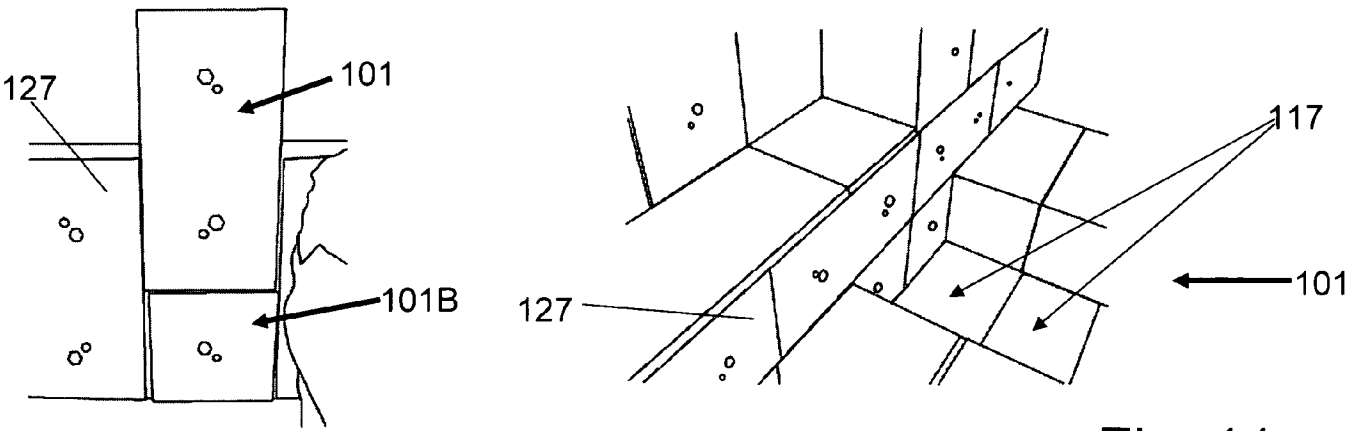
Fig. 11 D
Fig. 11 E
Fig. 11

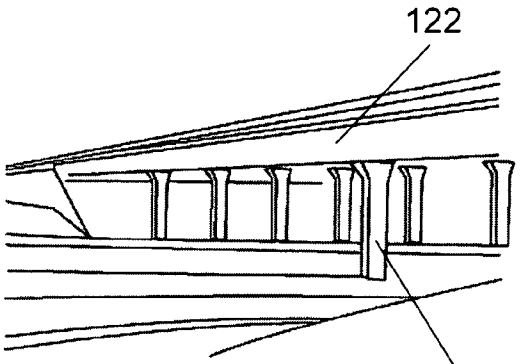
Fig. 13 A
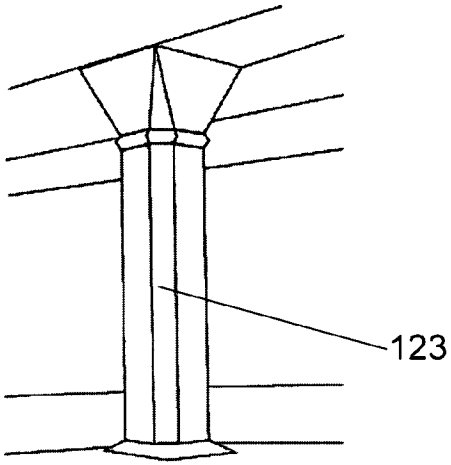
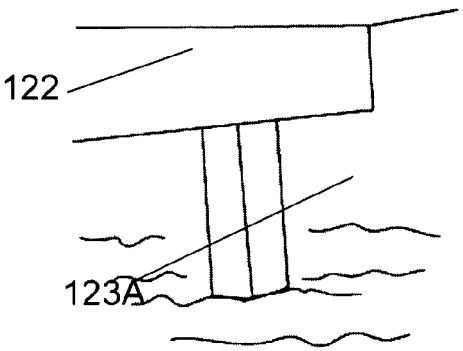
Fig. 13 C
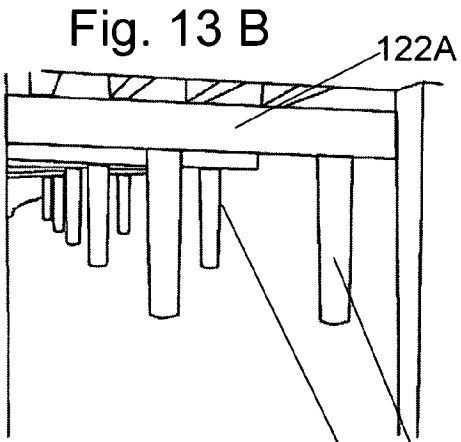
Fig. 13 B
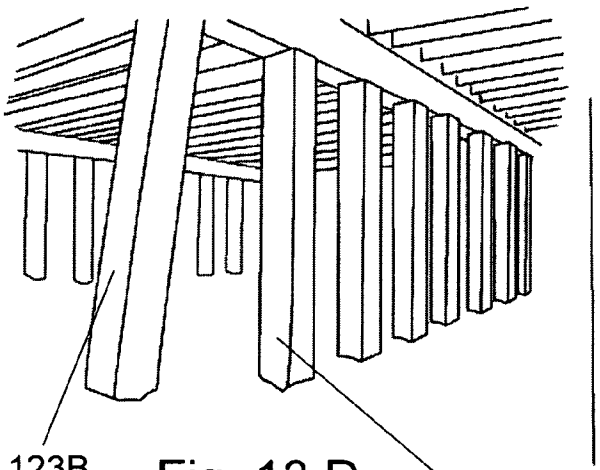
Fig. 13 D
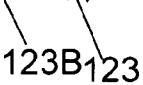
Fig. 13 E
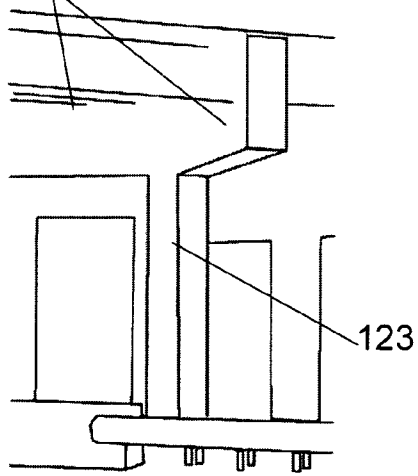
Fig. 13 F
Fig. 13

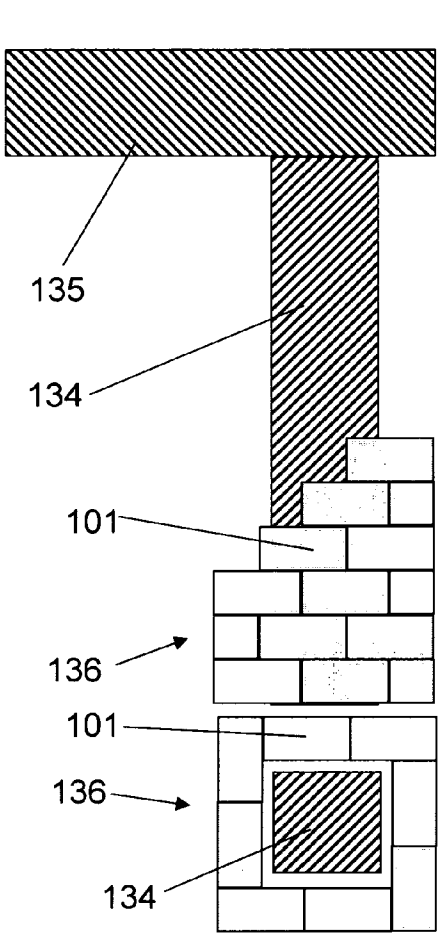
Fig. 14 C
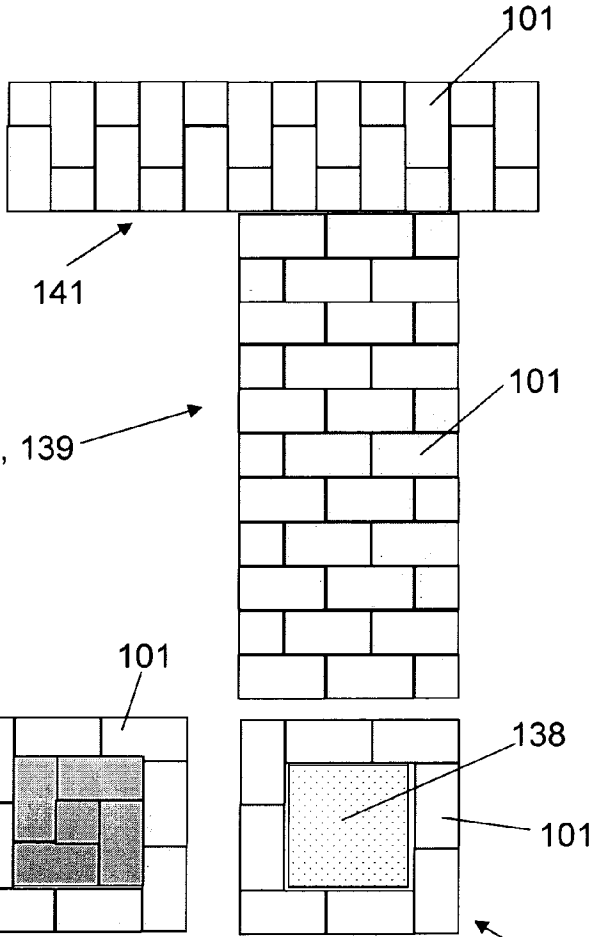
Fig. 14 B
Fig. 14
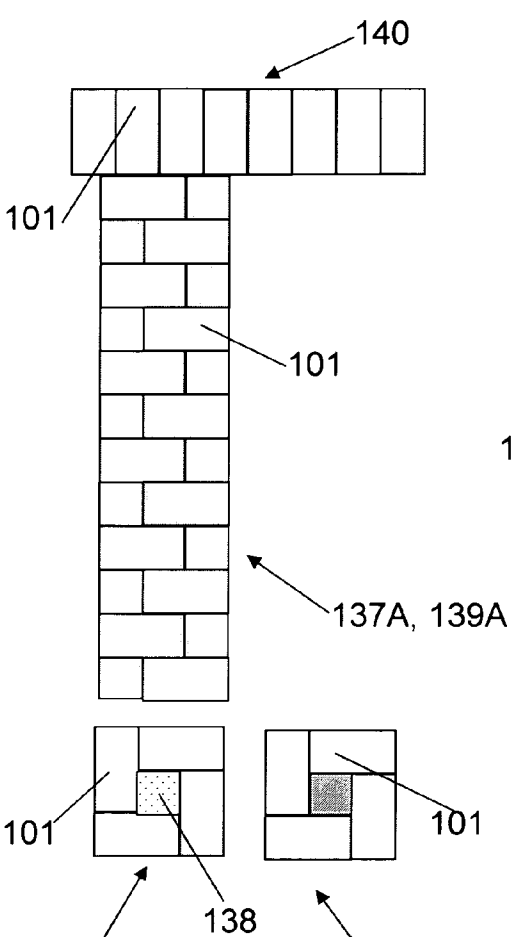
Fig. 14 A 104B
103A
103B
101B 129
128

127
116
103A
103B
A
A
132

103A
103B

Sect. A-A
131
130
116
127
132

124

Bolt-A-Blok™ SYSTEM COMPARISONS

| | FEATURE | Bolt-A-Blok | Traditional Wood Frame | Masonry Block | Reinforced |
|---|---|---|---|---|---|
| 1 | Material Cost | Medium | **Lowest** | High | Highest |
| 2 | Labor Cost | **Lowest** | Medium | High | Highest |
| 3 | Overall Cost | **Lowest** | Medium | High | Highest |
| 4 | Skill to Build | **Lowest** | Medium | High | Highest |
| 5 | Clean-up | **Lowest** | High | Medium | Highest |
| 6 | Strength | **Highest** | Lowest | Medium | High |
| 7 | Occupancy | **Immediate** | Delay/ Fnd'n | 14 Days | 21 Days |
| 8 | Environmental Impact | **Lowest** | Highest | Medium | Medium |
| 9 | Tools for Build | **Simple** | Medium | Medium | Complex |
| 10 | Vesatile Build | **Highest** | High | Medium | Low |
| 11 | Re-useable | **Yes** | Some | No | No |
| 12 | Water Use | **None** | Medium | High | Highest |

Fig. 17

125

SUPER UNITIZED POST TENSION BLOCK SYSTEM FOR HIGH HIGH STRENGTH MASONRY STRUCTURES—WITH SUPERSTRONGBLOKS

CROSS-REFERENCE TO RELATED APPLICATIONS

This application claims priority to then co-pending U.S. patent application Ser. No. 11/271,703, which was filed on Nov. 10, 2005, and which issued on Apr. 14, 2011, as U.S. Pat. No. 7,934,345; and then co-pending U.S. patent application Ser. No. 12/148,501, which was filed on Apr. 18, 2008, and which issued on Jan. 24, 2012, as U.S. Pat. No. 8,099,918.

This application claims the benefit of Provisional Patent Application Ser. No. 60/854,913 filed Oct. 27, 2006 and Ser. No. 60/925,302 filed Apr. 19, 2007. Both provisional applications were filed by Roger Marsh and Patricia Marsh and titled "SUPER UNITIZED POST TENSION BLOCK SYSTEM FOR HIGH STRENGTH MASONRY STRUCTURES—with SuperStrongBloks. It is believed that the first teaching of the post tensioning system was by the Bolt-A-Block system which was filed Nov. 10, 2005 by Roger Marsh et al (the same inventors for this application) with Ser. No. 11/271,703. The inventors provided another improved configuration of the unitized post tension system on Feb. 13, 2006 with Ser. No. 11/353,253 entitled UNITIZED POST TENSION BLOCK SYSTEM FOR MASONRY STRUCTURES. This application entails significantly new improvements and features to the block system and features of assembly not shown or present in the Bolt-A-Blok or Unitized Post tension systems of the previous applications. This new application shows and demonstrates additional configurations and methodology with significant improvements and features. This application shows a unique, novel super block with higher structural strength and characteristics differing from any earlier prior art.

FIELD OF INVENTION

This new building and construction system relates to a unitized masonry structure, particularly structures with post tensioned reinforcement and super heavy duty strength capabilities. The new building system is called SUPER UNITIZED POST TENSION BLOCK SYSTEM FOR HIGH STRENGTH MASONRY STRUCTURES (SUPER UPT BLOCK SYSTEM with SuperStrongBloks). The present invention relates generally to all types of construction where either reinforced concrete or alternatively structures with mortar and block or brick combinations are utilized for constructing high strength structures.

FEDERALLY SPONSORED RESEARCH

None.

SEQUENCE LISTING OR PROGRAM

None.

BACKGROUND—FIELD OF INVENTION

The new unitized masonry structure described in this specification, called a SUPER UNITIZED POST TENSION BLOCK SYSTEM FOR HIGH STRENGTH MASONRY STRUCTURES (SUPER UPT BLOCK SYSTEM), is a construction system that is designed to easily and quickly install in any location without the need for mortar, water, or power. The super, heavy duty configuration anticipates usage in many venues and arenas. These include military and defense applications, governmental uses, homeland security, and heavy duty/high strength applications for bridges, dams, levees and the like.

A. Introduction of the Problems Addressed

In prior art when a reinforcement means have been used with block, it is typically accomplished with either long rebars, long steel rods, threaded rods such as all-thread, and/or stranded cables. The common referral to "reinforced concrete" normally is without any tensioning of the steel reinforcement. The strength of this reinforced concrete is often dependent on the delivery and quality control by the providers of the concrete. In a few configurations, a construction design will call for or specify either pre-tensioning or post tensioning of the structure. The pre and post tensioning process, as one well skilled in the art of construction engineering and techniques knows, may increase the overall strength of the concrete structure but is still dependent on the quality of the delivered concrete. Until recently, post tensioning has normally only been used with a complete stack of blocks in conjunction with the placement of mortar between each layer. Until now, most specialty block systems with rods and plates have required very complex design and high levels of skill by construction designers and engineers. Heavy and super heavy construction has not been anticipated except as described basically in the application Ser. No. 11/353,253 entitled UNITIZED POST TENSION BLOCK SYSTEM FOR MASONRY STRUCTURES submitted Feb. 13, 2006.

B. Prior Art

In the last months of 2005, a newer technique of a bolt, block and bar system—called Bolt-A-Blok—introduced a basic unitized post tensioning where a loose bar was utilized as an anchor across the hollow cavity (or duct) of a concrete masonry unit (CMU) or block. The bar (anchor) had apertures with and without threads which were then individually connected by a fastener (a threaded through bolt) which is essentially the tendon. The combination bolt (tendon) and bar (anchor) network required some care in the placement of the bar to assure uniformity of the reinforcement web of the tendons and anchors. An improved method and system was developed called a UNITIZED POST TENSION BLOCK SYSTEM FOR MASONRY STRUCTURES which was devised that essentially "located" the bars uniformly in a recessed cavity or in a pocket of the concrete masonry unit (CMU). This application showed the basics of an alternative configuration with a full plate and duct system for possible use in military and possibly some structural works such as bridges, piers, levees, dams and the like. The anticipation of the original heavier block was a basic system without developed interconnects and methods to accomplish the more developed structural needs. The present new SUPER UNITIZED POST TENSION BLOCK SYSTEM FOR HIGH STRENGTH MASONRY STRUCTURES with SuperStrongBloks provides significantly improved configurations, assembly methods, and attachment means over all the previous art.

Historically, few patented devices have attempted to use mechanical means to join concrete masonry units. Prior to the Marsh efforts stated above, none used unitized post tensioning. This latest unique configuration stresses the high strength configuration and unique derivative of unitized post tensioning systems. As stated, the building industry has made little progress for a unitized, post tension system. Even so, blocks have required very special and often complex configurations to even handle rods and plates and then the prior art has taught only limited rods in special blocks. One such device is described in U.S. Pat. No. 5,511,902 (1996) issued to Center which teaches an Instant levy block system. This is a complex, specially made block for constructing a levy, comprising a plurality of blocks, a plurality of connecting pegs, and a plurality of stakes. Each part is uniquely designed and made whereas the new SUPER UNITIZED POST TENSION BLOCK SYSTEM FOR HIGH STRENGTH MASONRY STRUCTURES with SuperStrongBloks as described here utilizes a uniform, readily configured block design for a concrete masonry unit (CMU). It may be adapted and made at various strengths from 2000 PSI to 14000 PSI strengths in compression by varying the type of aggregate, the cement and the mix ratio of the two.

Another block device is described in U.S. Pat. No. 5,809,732 which was issued to Farmer, Sr. et al (1998) which teaches a masonry block with an embedded plate. The concrete masonry block has an external plate or plates that are anchored through the concrete masonry block. The external plates are cast into the concrete masonry block in the mold during casting. These plates and metal pieces are not taught as being part of the SUPER UNITIZED POST TENSION BLOCK SYSTEM FOR HIGH STRENGTH MASONRY STRUCTURES with SuperStrongBloks.

Another device for construction is taught by U.S. Pat. No. 6,098,357 issued to Franklin et al. (2000). This art discloses a modular pre-cast construction block system with a wall subsystem and a foundation subsystem. The wall subsystem has a number of wall units having cavities and pre-stressed tension cables are cast therein the cavity. This device teaches pre-cast walls and pass through cable which are specially made, require water, and are not readily re-useable like the SUPER UNITIZED POST TENSION BLOCK SYSTEM FOR HIGH STRENGTH MASONRY STRUCTURES with SuperStrongBloks. Also, the tensioning system is not unitized or placed throughout the entire structure.

A somewhat re-useable system is taught in the U.S. Pat. No. 6,178,714 issued to Carney, Jr. (2001). The long rods go through apertures in the specially cast block and the pre-cast structures. No description of pre or post tensioning is taught or claimed. The configuration of special length rods, special blocks, special plates and a complex system that requires powered equipment to construct is unlike the simple components of the SUPER UNITIZED POST TENSION BLOCK SYSTEM FOR HIGH STRENGTH MASONRY STRUCTURES with SuperStrongBloks.

A mortarless wall structure is taught in U.S. Pat. No. 6,691,471 issued to Price (2004). Price discloses a wall structure comprised of columns of preformed, lightweight, stacked blocks, with the columns of blocks connected to each other by elongated, vertically oriented, support beams. Preferably, the wall structure is operatively connected to a structure by one or more brackets. The beams and blocks are special configuration, not readily available and with limited uses.

A pre-cast, modular spar system having a cylindrical open-ended spar of relatively uniform cross section is taught in a U.S. Pat. No. 6,244,785 issued to Richter, et al (2001). The spar sections are formed by joining arcuate segments and stacking the sections. No design is shown that anticipates this SUPER UNITIZED POST TENSION BLOCK SYSTEM FOR HIGH STRENGTH MASONRY STRUCTURES with SuperStrongBloks.

An interlocking, mortarless system is accomplished by some other devices. However, none of them are found to show a structural unitized post tensioning system as described for the SUPER UNITIZED POST TENSION BLOCK SYSTEM FOR HIGH STRENGTH MASONRY STRUCTURES with SuperStrongBloks in the materials below. An example of one such interlocking device is taught by U.S. Pat. No. 4,640,071 issued to Haener (1987). The device provided includes a spaced parallel pair of upright sidewalls having flat bottoms and tops and bearing integral block interlocking connectors and various configurations on their opposite ends. The sidewalls are integrally connected by means of these configurations. This is not the configuration taught by the SUPER UNITIZED POST TENSION BLOCK SYSTEM FOR HIGH STRENGTH MASONRY STRUCTURES with SuperStrongBloks. Likewise, no post tensioning is taught to increase the structural integrity and strength.

None of the prior art nor the referenced previous applications by the inventors teaches all the features and capabilities of the SUPER UNITIZED POST TENSION BLOCK SYSTEM FOR HIGH STRENGTH MASONRY STRUCTURES (SUPER UPT BLOCK SYSTEM). As far as known, there are no systems at the present time which fully meet the need for a unitized, post-tensioned super heavy masonry block structure known as the SUPER UPT BLOCK SYSTEM. It is believed that this super system is made with simple, yet strong component parts; may be built with simple tools; needs no mortar or water; provides a much stronger structure than mortar structures and most reinforced concrete structures; and, is ready for immediate use and occupation upon completion of the construction. The combination of devices and the multiple new uses are unique to the SUPER UPT BLOCK SYSTEM.

SUMMARY OF THE INVENTION

A SUPER UPT BLOCK SYSTEM has been developed for use in constructing various types of heavy duty structures to replace masonry and reinforced concrete systems as the construction means. The SUPER UPT BLOCK SYSTEM is a building system that demountably couples each individual hollow cored block by use of a plate and bolt system. This coupling results in much stronger, faster, and less expensive construction of buildings when compared to standard block or reinforced concrete alternative systems. While the three main components—a plate, a bolt and a block—are securely connected, the means of attachment is capable of full disassembly if desired. The SUPER UPT BLOCK SYSTEM can be accomplished by persons with simple tools and instructions. There is no need for water, no special tools (a simple wrench will suffice), no bracing, and the structure constructed of the SUPER UPT BLOCK SYSTEM is ready for immediate use. The improved SUPER UPT BLOCK SYSTEM is comprised of masonry units (concrete masonry units) featuring hollow cores (small through-cavities or ducts), a high strength fastener bolt (tendon) and a plate (anchor). The new features also teach a strong and durable full plate and bolt which may be placed in various positions and which may be treated for corrosion resistance.

OBJECTS, ADVANTAGES AND BENEFITS

There are many, many benefits and advantages of the SUPER UPT BLOCK SYSTEM just as there are with the Unitized Post Tensioning prior art described above. There currently exist no construction systems, heavy or light duty, which use readily availably parts and are so easy to assemble. However, by having the unitized post tensioning technology, the structure is a far stronger unit than one built by traditional mortar-using techniques and reinforced concrete. TABLE A shows a list of new and distinct advantages and benefits of the SUPER UPT BLOCK SYSTEM over the prior art of the original Bolt-A-Block system (Ser. No. 11/271,703) and the Unitized Post Tensioning Systems (Ser. No. 11/353,253). TABLE B shows the list of advantages and benefits that SUPER UPT BLOCK SYSTEM has which are similar to the Bolt-A-Block and Unitized Post Tensioning Systems over traditional mortar and block and reinforced concrete systems. These advantages shown "carryover" to the new SUPER UPT BLOCK SYSTEM. TABLE C shows the list of advantages and benefits similar to the Unitized Post Tensioning Systems which were advantages over the original Bolt-A-Block system. These advantages in TABLE C also "carry over" to the new SUPER UPT BLOCK SYSTEM.

TABLE A

DISTINCT ADVANTAGES AND BENEFITS of SUPER UPT BLOCK SYSTEM OVER A BOLT-A-BLOK SYSTEM AND OTHER UPT SYSTEMS

| ITEM | DESCRIPTION |
|---|---|
| 1 | Provides a special template on plates for ease and speed of assembly - a carpet or grid for assembly of the SUPER UPT BLOCK SYSTEM |
| 2 | Provides precise placement of the anchor plates onto the CMU |
| 3 | May retrofit to damaged or deteriorated structures such as bridge columns, beams, |
| 4 | May retrofit to multi story buildings such as barracks for seismic and wind resistance |
| 5 | May place plates in vertical or horizontal planes or both |
| 6 | Provides high strength CMU with small duct |
| 7 | Assures a predictable concrete strength over poured reinforced alternative systems |
| 8 | Eliminates need for cooling pipes or means of exothermic cure in large reinforced pours such as large dams or levees |
| 9 | May be configured in multiple layers for anti-terrorist and personnel retention and deterrent walls |
| 10 | May be configured with open center areas for utilities, other materials or insulative means |
| 11 | Can be pre-assembled and assembly can be interrupted and restarted at any time without compromising quality. |
| 12 | Is useful with or without footer. |

TABLE B

ADVANTAGES SIMILAR TO BOLT-A-BLOK AND OTHER Unitized Post Tensioning SYSTEMS

| ITEM | DESCRIPTION |
|---|---|
| 1 | Is Waterless |
| 2 | Requires no wait time to get structural strength |
| 3 | Requires no temporary support while mortar cures and gains strength |
| 4 | Uses simple hand tools |
| 5 | Is Useful with/without footer |
| 6 | Has greater final tensile and compressive strength than mortar construction - is much stronger |
| 7 | Is Environmental friendly - Uses less wood, hence there is less deforestation required to support construction |
| 8 | Has a competitive total cost - material and labor |
| 9 | Permits rapid build. |
| 10 | Can be disassembled and components re-used. |
| 11 | Does not require skilled labor |
| 12 | Has Global/worldwide/universal applications |
| 13 | Can be built on soil or standard foundation |
| 14 | Spans greater distances between vertical double blocks |
| 15 | Is easy to learn the build concept and start building with non-skilled workers. With this easy learning curve, it is simple to learn and simple to use. So simple that multiple workers may be in the same area - not "laying" block but assembling a structure |
| 16 | Provides perfect spacing which means more attractive walls. Blocks have perfect alignment and correct placement before tightening |
| 17 | May provide Electrical grounding through metal bars |

TABLE B-continued

ADVANTAGES SIMILAR TO BOLT-A-BLOK AND OTHER Unitized Post Tensioning SYSTEMS

| ITEM | DESCRIPTION |
|---|---|
| 18 | Is an all weather construction. All kinds of weather, rain, snow, wind, cold, hot, underwater, even in a diving bell or caisson |
| 19 | Is a Unitized construction. If one stops or anything interrupts the build at any point, one can resume |

TABLE B-continued

ADVANTAGES SIMILAR TO BOLT-A-BLOK AND OTHER Unitized Post Tensioning SYSTEMS

| ITEM | DESCRIPTION |
|---|---|
| | immediately without the former problems of mortar drying out and the other messy problems. |
| 20 | May build a wall by working from either side. Inside or outside. |
| 21 | Works with one or more core block, brick, and other building units |
| 22 | Requires less scaffolding, ladder jacks and walk boards because the walls are immediately at full strength. |
| 23 | Can pour concrete in cores and even add vertical rebars. |
| 24 | Can pour insulation or spray foam in cores. |
| 25 | Resists flying debris. |
| 26 | Resists Earthquake and Hurricane/tornado. |
| 27 | Is fire resistant. |
| 28 | Is not dependent on mortar strength |
| 29 | Requires no power or gasoline to build |
| 30 | Is useable with other construction techniques - door and window frames, roof and ceiling joists and trusses; metal and asphalt/fiber/rubber roofing; |
| 31 | Is useable with standard plumbing, electrical, communications and lighting packages |
| 32 | Has the ability to construct several block layers at one time - speeds overall construction |
| 33 | Adapts to regular interior (plaster, boars, panel, paint) and exterior wall surfaces (siding, brick, stucco, etc) |
| 34 | Provides perfect plumb and level alignment |

TABLE B-continued

| ADVANTAGES SIMILAR TO BOLT-A-BLOK AND OTHER Unitized Post Tensioning SYSTEMS | |
|---|---|
| ITEM | DESCRIPTION |
| 35 | Does not require poured foundations |
| 36 | Is a Unit by unit construction |
| 37 | Is possible for the builder to leave out a small portion of the foundation wall so that trucks and backhoes can easily cross into the structure to grade, spread stone, unload concrete or do whatever is necessary. As soon as the heavy inside work is completed, the wall is quickly, bolted into place and is ready to go, at full strength. |
| 38 | Is termite and carpenter ant proof. |

TABLE C

| ADVANTAGES SIMILAR TO UNITIZED POST TENSIONING SYSTEMS AND OVER BOLT-A-BLOCK SYSTEMS | |
|---|---|
| ITEM | DESCRIPTION |
| 1 | elimination of any gap between the CMUs. No filling or caulking of the space is required. |
| 2 | precise placement of the anchor bar |
| 3 | faster build time with the recessed channels or the embedded bars |
| 4 | stronger military/defense use and anti-blast applications |
| 5 | features for easier, faster build with placement aids |

For one skilled in the art of construction of structures (especially masonry, concrete, and steel structures) it is readily understood that the features, advantages and benefits shown in the examples with this system are readily adapted to other types of construction improvements.

DESCRIPTION OF THE DRAWINGS—FIGURES

The accompanying drawings, which are incorporated in and constitute a part of this specification, illustrate an embodiment of the SUPER UNITIZED POST TENSION BLOCK SYSTEM FOR HIGH STRENGTH MASONRY STRUCTURES (SUPER UPT BLOCK SYSTEM) that is preferred. The drawings together with the summary description given above and a detailed description given below serve to explain the principles of the SUPER UPT BLOCK SYSTEM. It is understood, however, that the SUPER UPT BLOCK SYSTEM is not limited to only the precise arrangements and instrumentalities shown.

FIG. 3 are sketches of prior art for the heavy duty Unitized Post tension system of previous applications.

Figures 5, 5A, 5B, 5C, 5D, 5E, 5F:
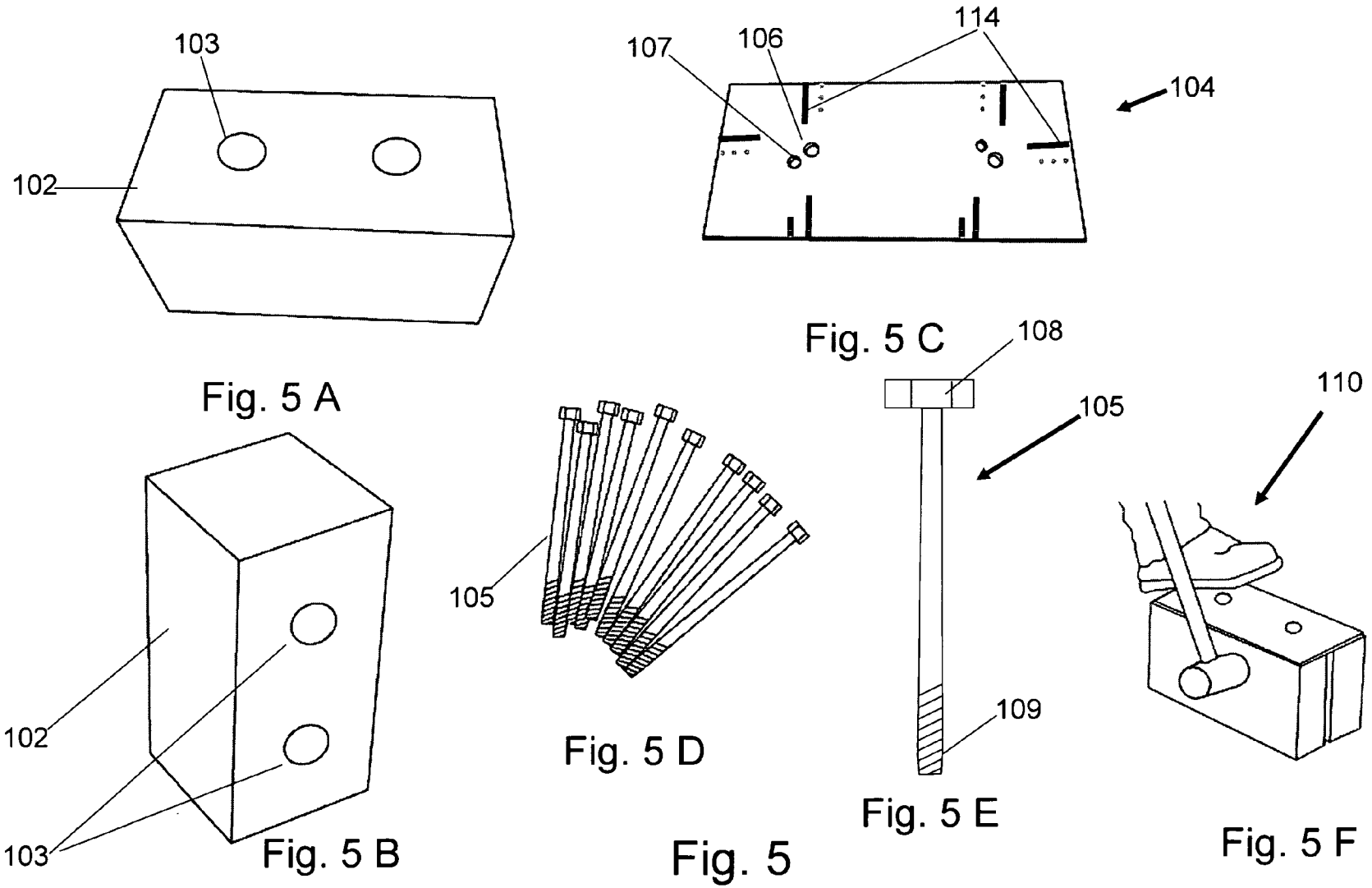

FIGS. 5 A to 5 F are sketches of prototypes and of the components of the assembly of the SUPER UNITIZED POST TENSION BLOCK SYSTEM FOR HIGH STRENGTH MASONRY STRUCTURES.

FIG. 6 are various configurations of the new SUPER UPT BLOCK SYSTEM with the post tensioned reinforcement and super heavy duty strength capabilities.

Figures 7, 7A, 7B, 7C, 7D, 7E:
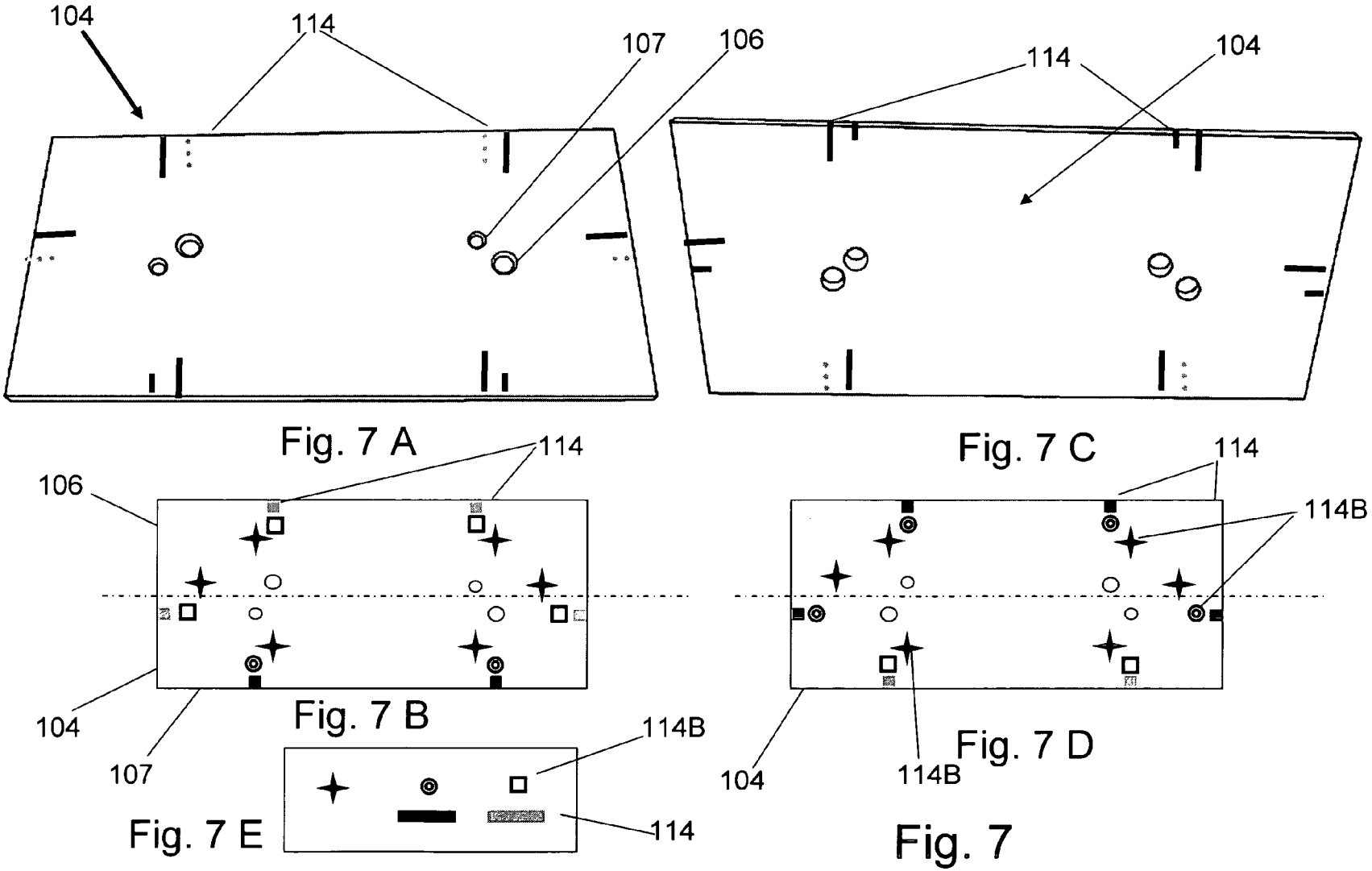

FIGS. 7 A through 7 D show the details of the main plate or anchor device complete with location markings for ease and speed of assembly.

Figures 8, 8A, 8B, 8C:
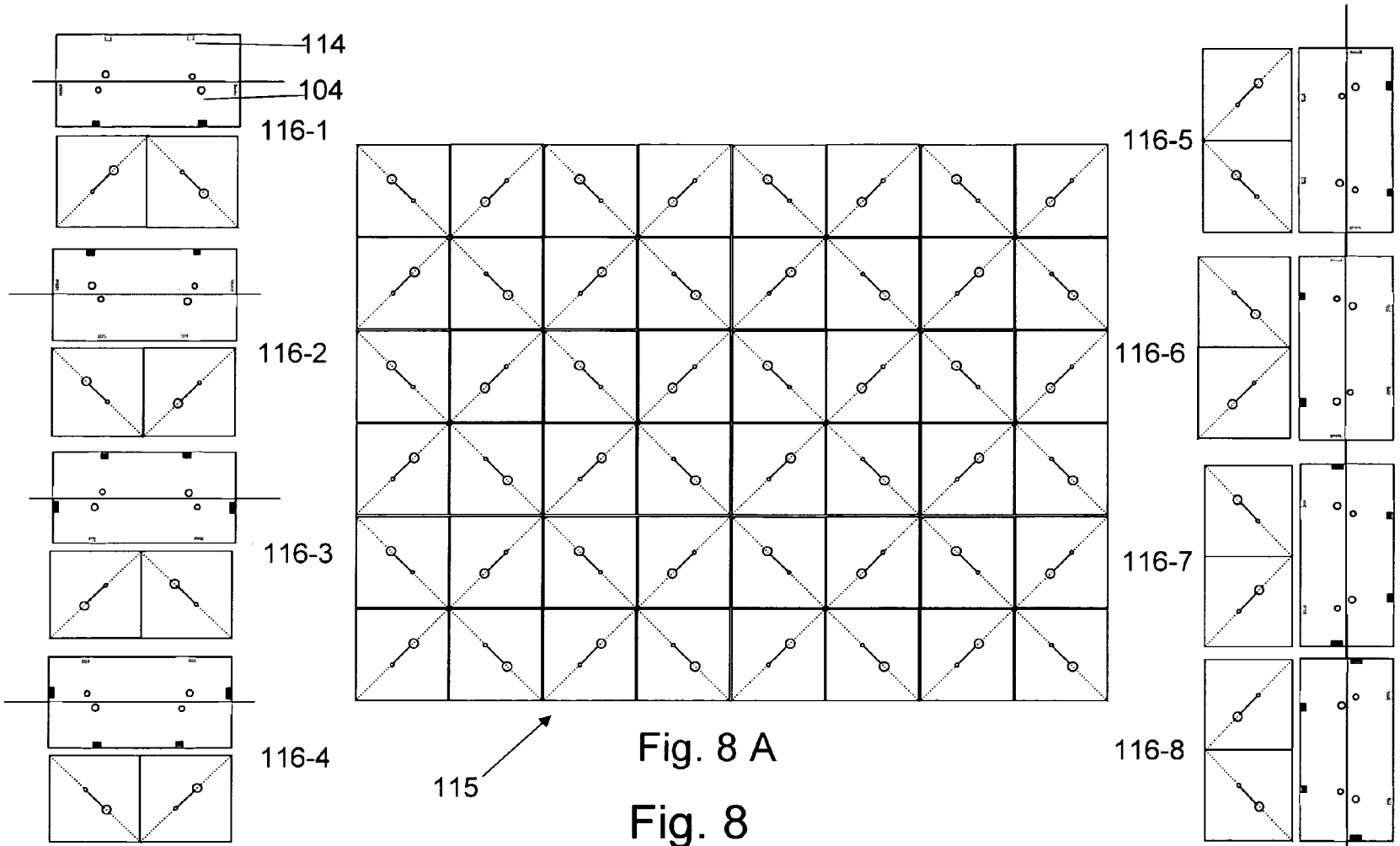

FIGS. 8 A through 8 C are sketches of the grid alignment provided by the delineated and specially marked plates or anchors in the SUPER UPT BLOCK SYSTEM.

Figure 9:
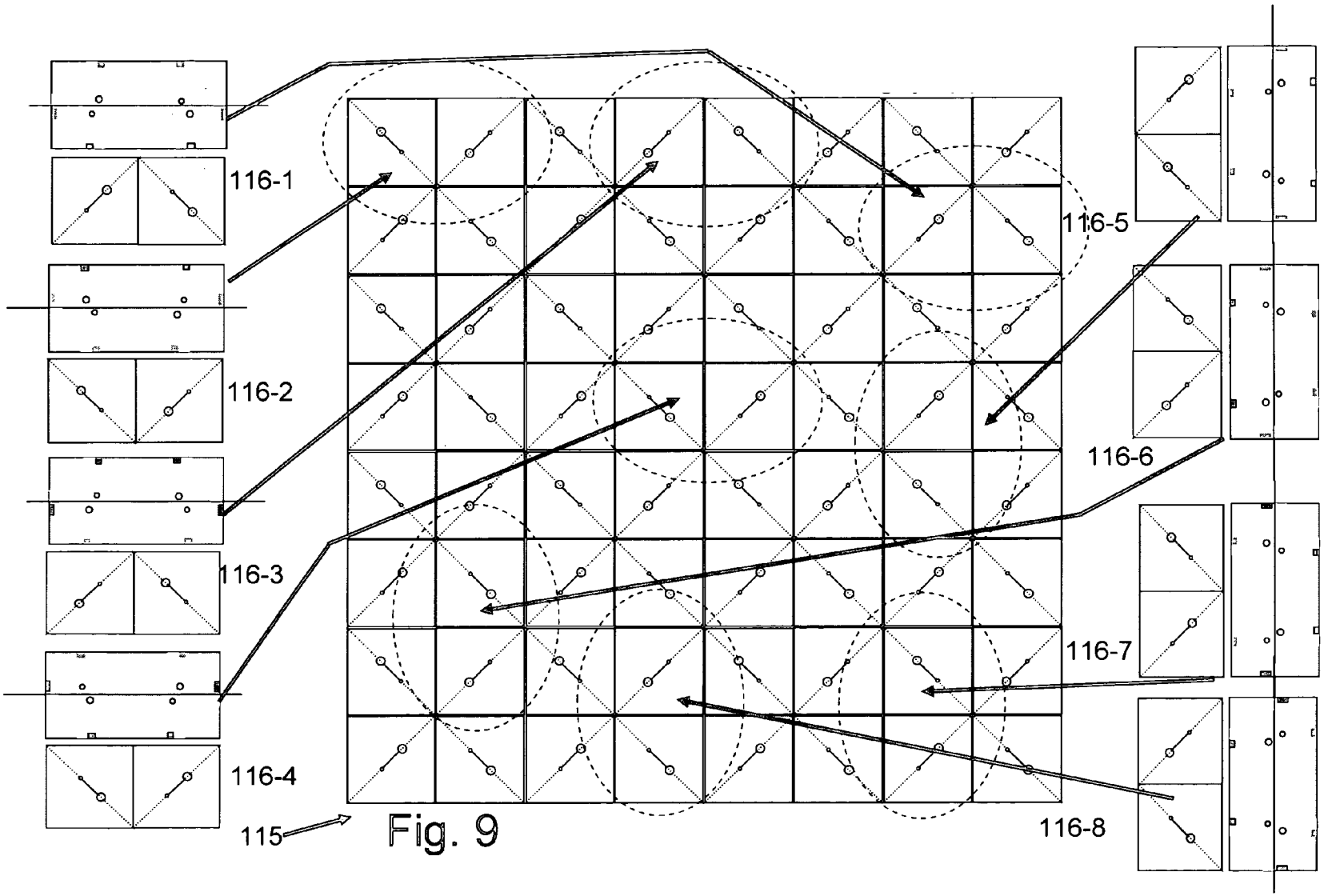

FIG. 9 is further details of the grid alignment plates for the SUPER UPT BLOCK SYSTEM.

Figures 10, 10A, 10B, 10C, 10D, 10E, 10F:
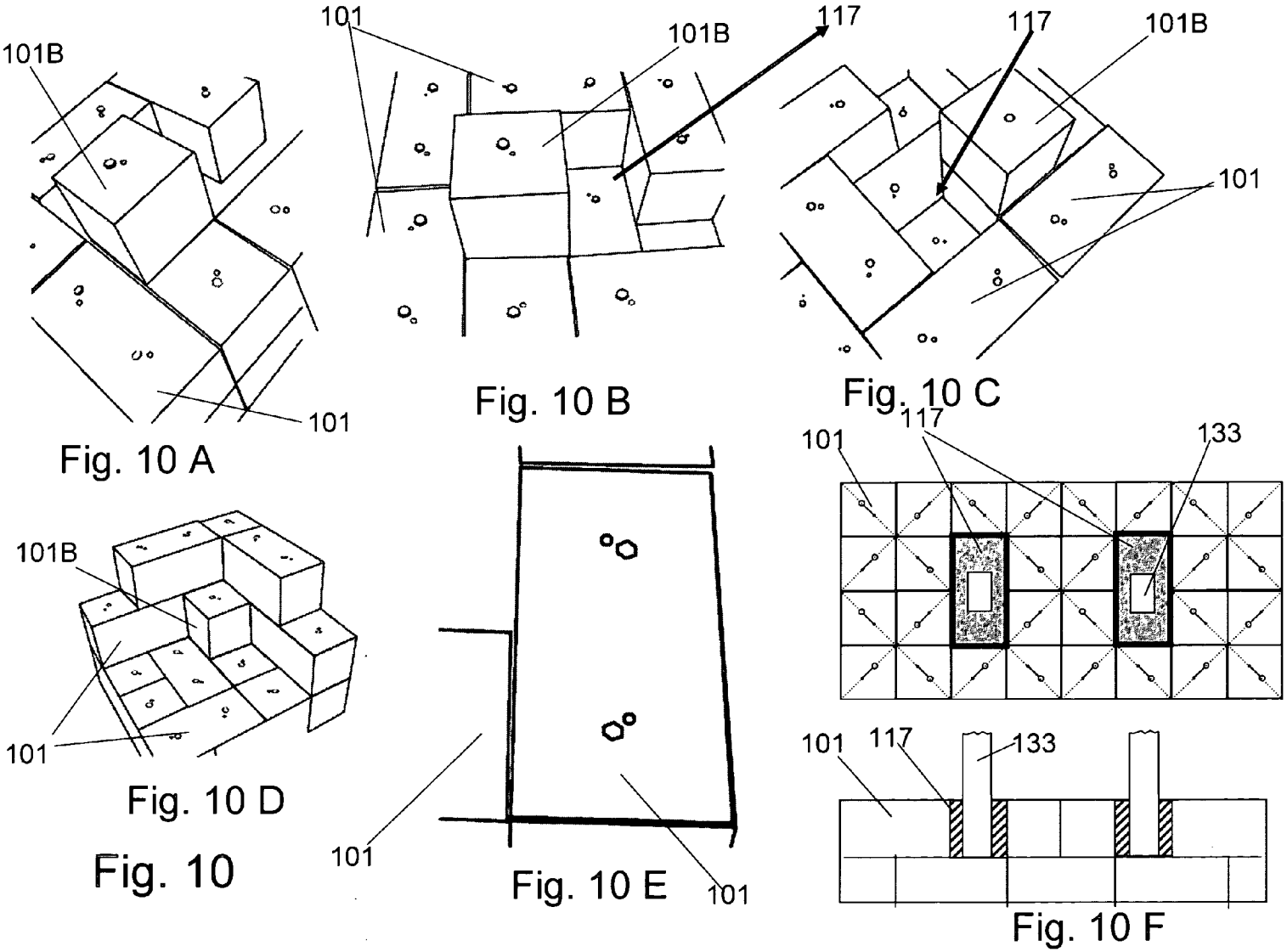

FIGS. 10 A through 10 E provide prototype sketches of the SUPER UPT BLOCK SYSTEM with the strength plates in various horizontal configurations. FIG. 10 F is a sketch of the SUPER UPT BLOCK SYSTEM used for a sign post installation.

FIGS. 11 A through 11 E provide prototype sketches of the SUPER UPT BLOCK SYSTEM with the strength plates in various vertical configurations.

Figure 12:
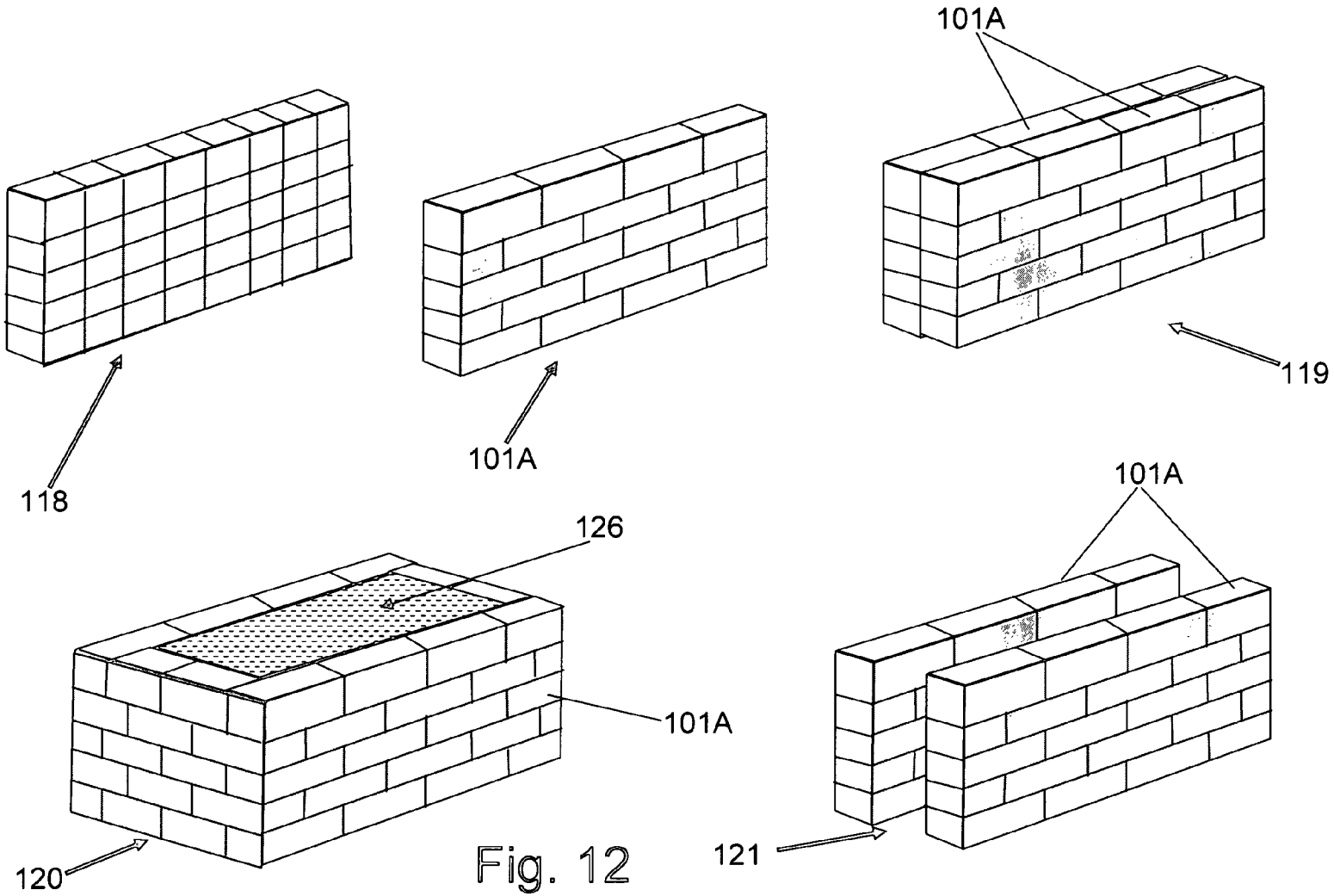

FIG. 12 shows sketches of examples of the SUPER UPT BLOCK SYSTEM in various protective wall configurations.

FIGS. 13 A through 13 F show sketches of various reinforced columns and beams in typical structural systems which are potential applications for the SUPER UPT BLOCK SYSTEM.

FIGS. 14 A through 14 C show sketches of columns and beams for both new structures and examples of retrofitting deteriorating or damaged structures with the SUPER UPT BLOCK SYSTEM.

Figures 15, 15A, 15B, 15C, 15D, 15E:
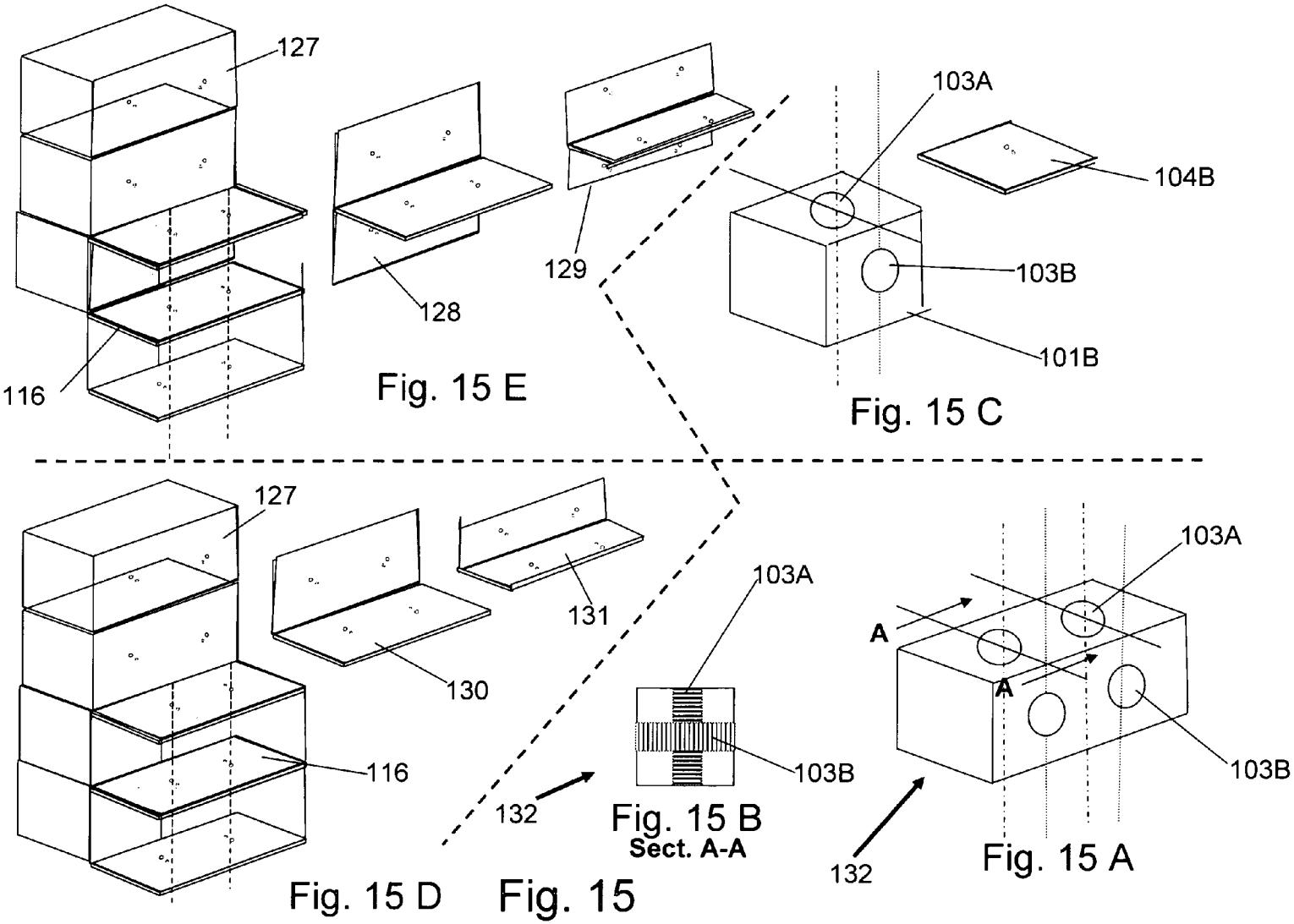

FIGS. 15 A through 15 E show various auxiliary connection means and auxiliary block configurations for the SUPER UPT BLOCK SYSTEM.

Figure 16:
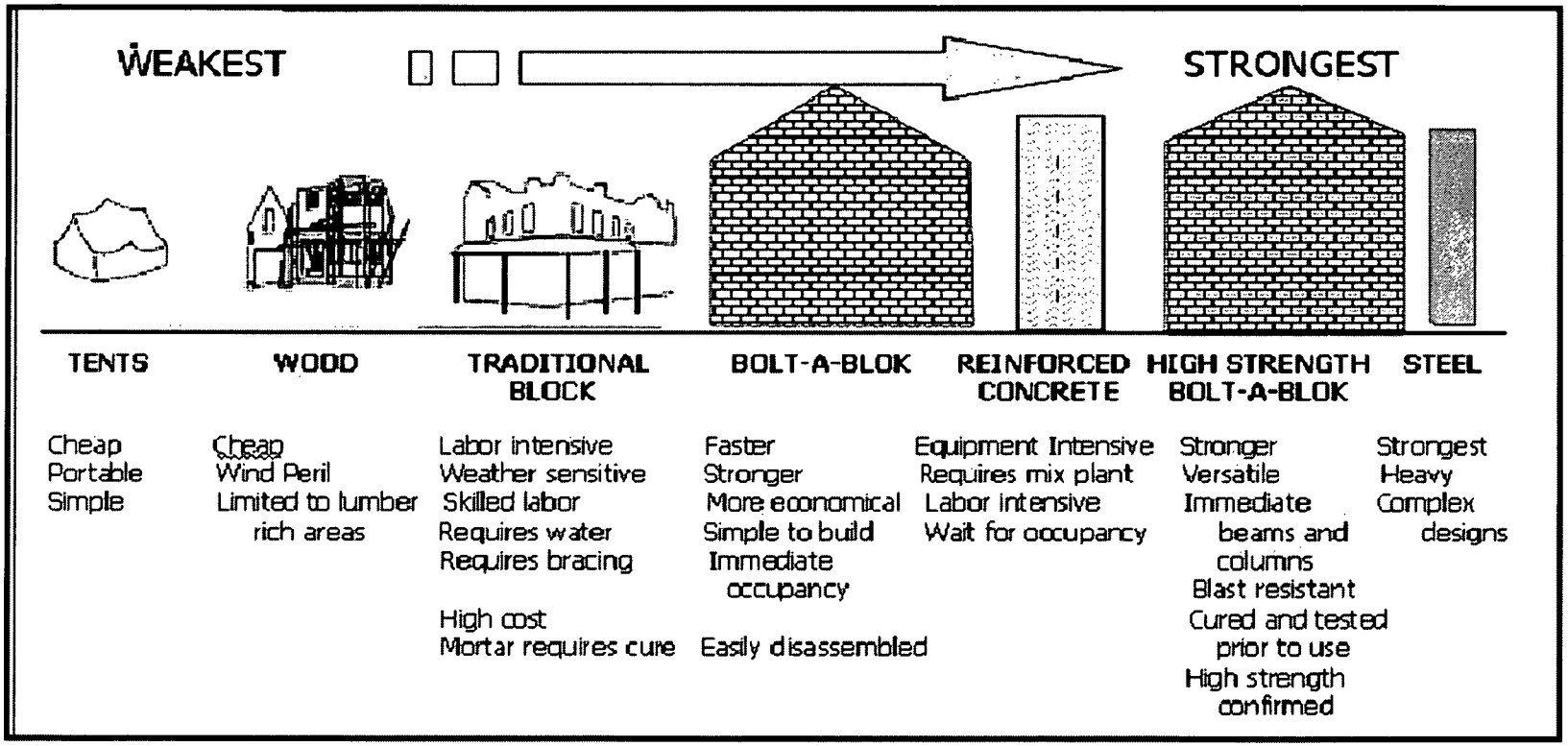

FIG. 16 shows a transition and comparison sketch for various shelters over the ages.

FIG. 17 shows a comparison table of features and functions for various building systems used in modern times.

| | |
|---|---|
| 48 | hollow cavity in a CMU |
| 87 | general parts for high strength (military defense or anti-terrorism) configuration of the UNITIZED POST TENSION BLOCK SYSTEM |
| 87A | assembly of the high strength (military defense or anti-terrorism) configuration of the UNITIZED POST TENSION BLOCK SYSTEM |
| 88 | full coverage CMU surface plate anchor for post tensioning |
| 89 | high density CMU with relatively small cavity |
| 90 | high strength tendons such as #5 or #8 grade steel or equal |
| 91 | miscellaneous anchors for attachment to foundation or mounted structure |
| 98 | through hole aperture in anchor(bar) for post tensioning |
| 99 | threaded hole aperture in anchor(bar) for post Tensioning |
| 101 | General high strength super block configuration |
| 101A | Assembly of several high strength super block Configurations(CMU, Plate and Bolts) |
| 101B | One-half block configuration(CMU, Plate and Bolts) |
| 102 | Concrete Masonry unit with minimal cavity and maximum concrete |
| 102B | One-half block configuration of Concrete Masonry unit with minimal cavity and maximum concrete |
| 103 | Minimum cavity (duct) |
| 103A | Minimum cavity (duct)essentially vertical |
| 103B | Minimum cavity (duct)essentially vertical |
| 104 | High Strength, corrosion resistant plate |
| 104B | High Strength, corrosion resistant plate for a Half Block |
| 105 | High strength corrosion resistant fastening means such as bolts or the like |
| 106 | Through hole |
| 107 | Threaded Hole |
| 108 | Means to turn the fastener such as a hex head or the like |

-continued

| | |
|---|---|
| 109 | Tapered thread |
| 110 | Impact testing means |
| 111 | stack (soldier) bond |
| 111A | horizontal stack bond |
| 112 | running bond |
| 113 | miscellaneous random configuration |
| 114 | alignment demarcation means (paint, color coded or other) |
| 114B | alignment demarcation means-geometric marks |
| 115 | match-up grid |
| 116-1 | Horizontal Plate-Zero Position |
| 116-2 | Horizontal Plate-180 degree position |
| 116-3 | Horizontal Plate-Zero Flipped to reverse |
| 116-4 | Horizontal Plate-Flipped to reverse-180 degree position |
| 116-5 | Horizontal Plate-270 degree position |
| 116-6 | Horizontal Plate-90 degree position |
| 116-7 | Horizontal Plate-Flipped to reverse-90 degree position |
| 116-8 | Horizontal Plate-Flipped to reverse-270 degree position |
| 117 | aperture/opening between block |
| 118 | stack or soldier bond (vertical or horizontal plates) |
| 119 | multiple (two or more) wall structures (vertical or horizontal plates) |
| 120 | filled wall structures(vertical or horizontal plates) |
| 121 | spaced wall structures (with open air between structures-vertical or horizontal plates) |
| 122 | structural beams (reinforced concrete or the like) |
| 123 | structural columns (reinforced concrete or the like) |
| 123A | Corroding reinforced concrete columns |
| 123B | Displaced reinforced concrete columns |
| 124 | Chart of shelter building types |
| 125 | Comparison Chart of modern building techniques |
| 126 | Fill material (indigenous stone, earthen materials, or the like) |
| 127 | Vertical plates-same as horizontal plates 116 as described above, including demarcations 114, 114B |
| 128 | tee plate structural member-two vertical plates 127 and one horizontal plate 116 configured and securely attached by a means (integral forming, welding or the like) |
| 129 | tee structural member which attaches to horizontal plates 116 and 127 by a secure means (removable-under bolts or fixed - welded or the like) means to attach the horizontal and vertical walls |
| 130 | ell or angle plate structural member-one vertical plate 127 and one horizontal plate 116 configured and securely attached by a means (integral forming, welding or the like) |
| 131 | ell or angle structural member which attaches to plates 116 and 127 by a means to secure the horizontal and vertical walls |
| 132 | Block with two way duct (103A and 103B in same block) |
| 133 | Structural member for vertical support-I beam, H beam, C channel, square, rectangular or round tubes, or the like-for use with embedded items such as, for example, sign posts |
| 134 | existing damaged or deteriorated column |
| 135 | existing beam |
| 136 | retrofitting SUPER UPT BLOCK SYSTEM column in a surrounding configuration |
| 137 | new SUPER UPT BLOCK SYSTEM column with an open center |
| 137A | new, smaller cross-section SUPER UPT BLOCK SYSTEM column with an open center |
| 138 | center area of a new SUPER UPT BLOCK SYSTEM column |
| 139 | new SUPER UPT BLOCK SYSTEM column with a solid center |
| 139A | new, smaller cross-section SUPER UPT BLOCK SYSTEM column with a solid center |
| 140 | soldier type SUPER UPT BLOCK SYSTEM beam |
| 141 | new SUPER UPT BLOCK SYSTEM structure with an open center |

DETAILED DESCRIPTION OF PREFERRED EMBODIMENT

The present invention is a construction system called a SUPER UNITIZED POST TENSION BLOCK SYSTEM FOR HIGH STRENGTH MASONRY STRUCTURES (SUPER UPT BLOCK SYSTEM 101). This post tensioning system is comprised of only a few different types of components—masonry units (concrete masonry units) featuring hollow cores (small through-cavities or ducts), a high strength fastener bolt (tendon) and a plate (anchor). The new features also teach a strong and durable full plate and bolt which may be treated for corrosion resistance. A super heavy duty hollow core block 102 (and others) in which the hollow cavity 103 is the duct, a series of tendons (such as a through bolt) 105, and a plurality of anchors (such as a plate) 104 with some additional features. The system 101 is configured with the plurality of adjacent blocks 102 contiguous and touching one another and demountably coupled to each other by means of the tendons 105 and anchors 103. This new coupling with SUPER UPT BLOCK SYSTEM results in a structure that is formed from a plurality of unitized, post tensioned concrete masonry units that collectively are far stronger than an ordinary block structure built with mortar and standard reinforcing. SUPER UPT BLOCK SYSTEM has more predictable and controlled strength to be overall a stronger system than most reinforced concrete systems. A person having ordinary skill in the field of construction, especially with reinforced concrete and masonry structures, appreciates the various parts that may be used to physically permit this SUPER UPT BLOCK SYSTEM 101 to be produced and utilized. The improvement over the existing art provides a construction system that has many advantages and benefits as stated in the previous section entitled "Objects, Advantages, and Benefits", above. The advantage over the newer Bolt-A-Blok and UNITIZED POST TENSION BLOCK SYSTEM FOR MASONRY STRUCTURES includes the much higher strength capabilities for military, government and various structures such as bridges, dams, levees and the like.

There is shown in FIGS. 1 through 17 a complete operative embodiment of the SUPER UPT BLOCK SYSTEM 101 prior art, and many uses and applications for the SUPER UPT BLOCK SYSTEM. In the drawings and illustrations, one notes well that drawings and sketches demonstrate the general configuration of this invention and its uses. The preferred embodiment of the system is comprised of only a few parts as shown. Various important features of these components are also delineated and are described below in appropriate detail for one that is skilled in the art to appreciate the importance and functionality of the SUPER UPT BLOCK SYSTEM 101.

The accompanying drawings, which are incorporated in and constitute a part of this specification, illustrate embodiments of the SUPER UPT BLOCK SYSTEM 101 that are preferred. The drawings together with the summary description given above and a detailed description given below serve to explain the principles of the SUPER UPT BLOCK SYSTEM 101. It is understood, however, that the SUPER UPT BLOCK SYSTEM 101 is not limited to only the precise arrangements and instrumentalities shown.

Figure 1:
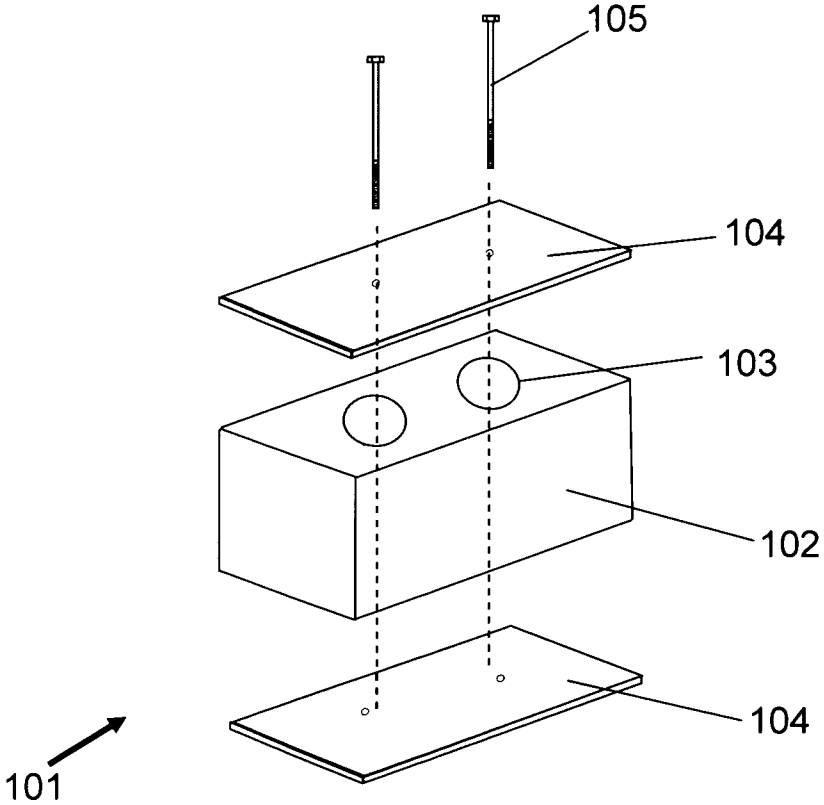
FIG. 1 shows a sketch of the configuration for a SUPER UNITIZED POST TENSION BLOCK SYSTEM FOR HIGH STRENGTH MASONRY STRUCTURES.

FIG. 1 shows a sketch of the configuration for a SUPER UNITIZED POST TENSION BLOCK SYSTEM FOR HIGH STRENGTH MASONRY STRUCTURES or SUPER UPT BLOCK SYSTEM 101. The improved SUPER UPT BLOCK SYSTEM 101 is comprised of masonry units 102 (concrete masonry units) featuring hollow cores (small though cavities or ducts) 103, a high strength fastener bolt (tendon) 105 and a plate (anchor) 104. The new features also teach that the plate 104 is strong and durable and the plate 104 and bolt 105 may be placed in various positions. Each (the plate 104 and bolt 105) may be treated for corrosion resistance.

Figure 2:
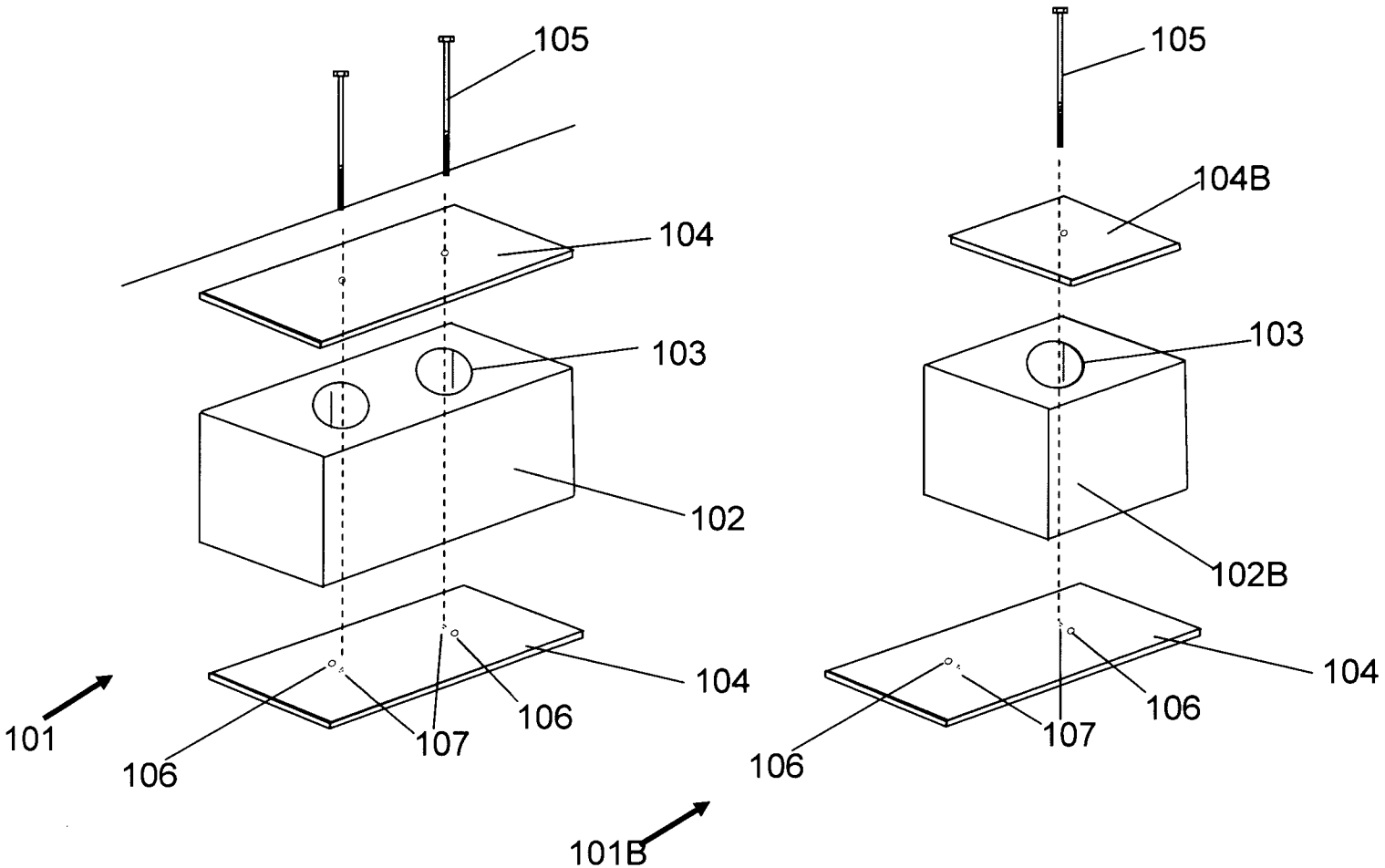
FIG. 2 shows a sketch of the configuration for a SUPER UNITIZED POST TENSION BLOCK SYSTEM FOR HIGH STRENGTH MASONRY STRUCTURES with the component features delineated.

FIG. 2 shows a sketch of the configuration for a SUPER UNITIZED POST TENSION BLOCK SYSTEM FOR HIGH STRENGTH MASONRY STRUCTURES or SUPER UPT BLOCK SYSTEM 101 with the component features delineated. These SuperStrong Components include the SuperStrongBloks 102, SuperStrong Plates 104 and SuperStrong Bolts 105. The overall configuration of the SUPER UPT BLOCK SYSTEM 101 will also employ and utilize an occasional half block 102B and half plate 104B to complete the structure 101B. In addition to the block 102 and half block 102B, the plate configuration 104 also has features built in for connecting the bolt or tendon 105 to the plate or anchor 104. The example employed is a through hole 106 and a threaded hole 107. The bolt 105 passes through the open, non-threaded through hole 106, down through the cavity 103, and engages the lower plate 104 in the threaded aperture 107. One skilled in the art appreciates that there are many fastening means to equally accomplish this connection. However the open aperture 106 and the threaded aperture 107 in conjunction with the threaded through bolt 105 is the means of the preferred embodiment. These simple components are all that is needed to permit one to build the largest, strongest structure that one might visualize. These components, the SuperStrongBloks 102, SuperStrong Plates 104 and SuperStrong Bolts 105 are all Post-Tensioned, adding literally tons of extra strength to each unit. (Empirical tests may support this conclusion). As one visualizes the structure, the SuperStrong Components (102, 104, and 105) can be made in any relative size for the desired structure.

As an example, and not as a limitation, one might use a SuperStrongBlok 102 whose outer dimensions are 7.625×7.625×15.25 inches. Importantly, the ratio of the dimensions is 1:1:2. This is different than a standard concrete block, which has a ratio of 1:1:2.05. Note the SuperStrongBlok 102 is nearly solid, leaving only enough room for the tendons (bolts) 105 to go through the precast ducts (cores) 103. As a further explanation of the example (and not limiting the concept), the SuperStrongBlok 102 could have a 12,000 PSI compressive strength (or more) of concrete. This would permit each SuperStrongBlok 102 to support 1.4 million pounds because of the increased surface area over a similar standard concrete masonry unit. If needed, the 12,000 PSI strength could be controlled and confirmed by tests at the point of manufacturing in the block fabrication plant. The predictable strength of the concrete block in the SUPER UPT BLOCK SYSTEM is a significant advantage over reinforced concrete. Confirmation of the actual strengths may be made through destructive or non-destructive tests of a sample of the blocks manufactured.

FIG. 3 are sketches of prior art for the heavy duty Unitized Post tension system 87 of previous applications. It is a simple heavy duty option. The overall CMU 89 is still connected to anchor plates 88 and bolt/tendons 90 through the hollow cavities 48. The anchors 88 are full plates. This eliminates any gap as shown in the Bolt-A-Blok prior art. These plates 88 are made of metal such as steel. FIG. 3 A shows a tendon 90 for each cavity that is connected to the plates 88 by the threaded apertures 98 in the plate 88. The unthreaded through hole 99 is the location to place the next tendon for connection to the lower plate. FIG. 3 B shows that a plurality of tendons 90 may be used to create even greater post tensioning if desired. Additional tendons 90 require correspondingly additional apertures 98, 99 in the anchor plates 88. FIG. 3 C shows an application for the heavy duty application 87A. In this example, a series of the heavy duty CMUs 89 are placed and assembled. However the anchors are now full surface plates 88. The tendons 90 are high strength through bolts or other strong, durable tendons. Also, the initial base anchors may be of various configurations 91 for attachment into a concrete pad, direct to compacted stone, or directly into the earth. These various configurations 91 may be of varying lengths to accommodate the construction needs.

Figure 4:
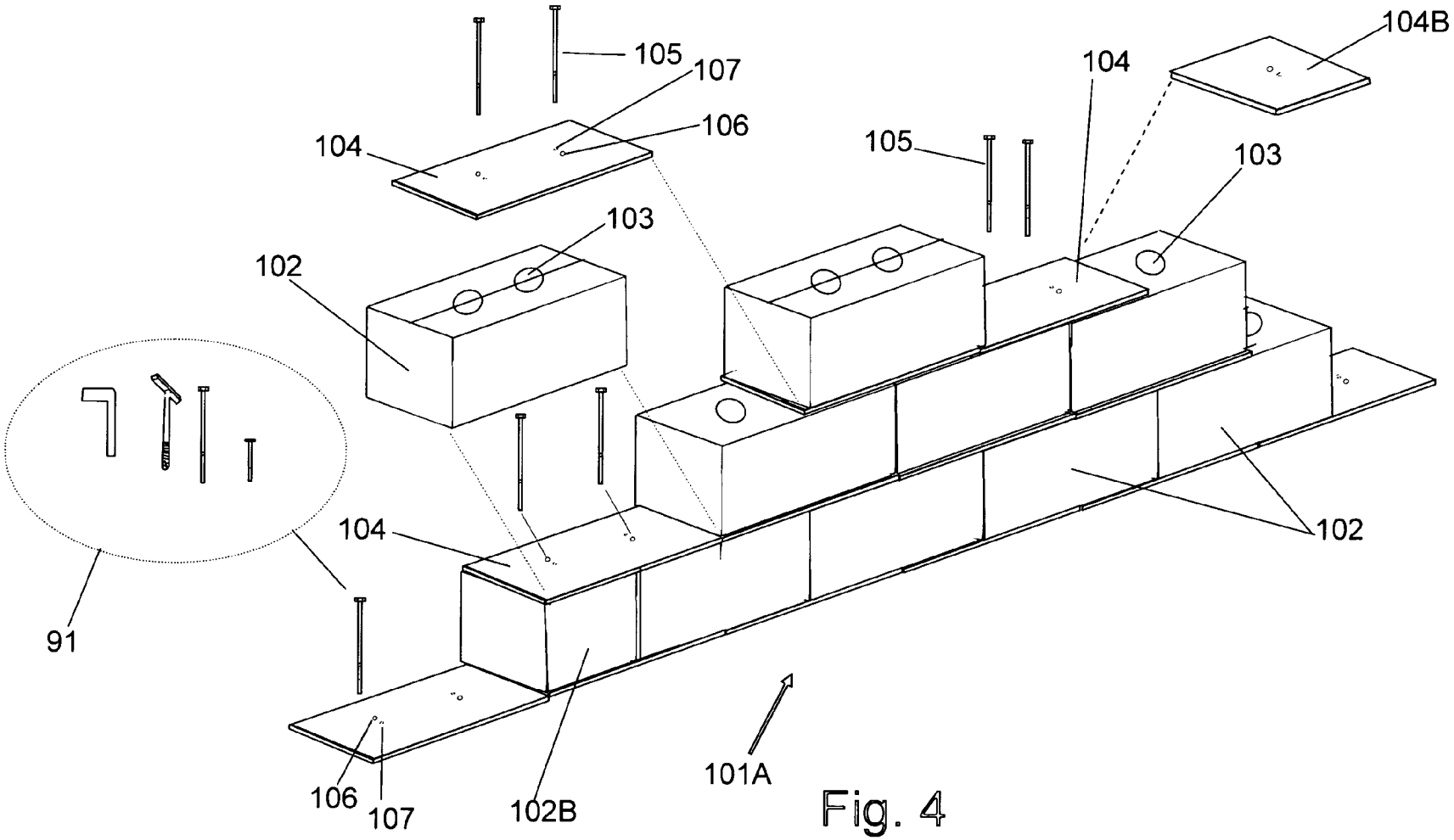
FIG. 4 is a general wall assembly of the SUPER UNITIZED POST TENSION BLOCK SYSTEM FOR HIGH STRENGTH MASONRY STRUCTURES.

FIG. 4 is a general wall assembly of the SUPER UNITIZED POST TENSION BLOCK SYSTEM FOR HIGH STRENGTH MASONRY STRUCTURES 101A. Here the wall configuration with the blocks 102 and plates 104 are lineal and horizontal although it will be shown that the plates 104 and blocks 102 can be placed in virtually any direction. As described above, the configuration such as this example will use full blocks 102 and half blocks 102B as well as whole plates 104 and half plates 104B. In all cases the tendons or bolts 105 are utilized as the preferred means to connect the plates (anchors) 104, 104B on each side of the blocks 102, 102B. This placement facilitates the post tensioning of the configuration 101A. The final tensioning torque (and resulting pressure) may vary from application to application. Empirical testing will reveal the appropriate tensioning for the required application. For example, a common wall or blast barrier may perform best at a proscribed torque whereas a hurricane or seismic-resistant (earthquake) systems may require other sets of torques and resultant tensions. This is all well understood by those skilled in the art of structural systems and may be demonstrated and confirmed by a variety of empirical testing. The features of the open aperture 106 and the threaded aperture 107 are also shown in this figure. Finally, attachment anchors 91 are employed to attach the system 101A to the supporting surface as described with the prior art in FIG. 3, above.

FIGS. 5 A to 5 F are sketches of prototypes and of the components of the assembly of the SUPER UNITIZED POST TENSION BLOCK SYSTEM FOR HIGH STRENGTH MASONRY STRUCTURES (SUPER UPT BLOCK SYSTEM 101). The components of the SUPER UPT BLOCK SYSTEM 101 are shown to complement the above FIG. 4 as to how all the components are assembled together. The SUPER UPT BLOCK SYSTEM 101A is an integrated building system that uses just 3 parts—SuperStrong Components (102, 104, and 105). The uniquely shaped blocks 102 are designed to nest next to each other in any configuration and pattern, leaving no joining voids or gaps. Each full super block 102 has two core holes 103 to serve as ducts for the tendons 105. FIG. 5 A shows a SuperStrongBlok 102. FIG. 5 B show the SuperStrongBlok 102 with the ducts 103. The SuperStrongBloks 102 potentially supports 1.4 Million Pounds. The SuperStrongBlok 102 prototype weighs only approximately 68 pounds. A Superblok 102 example would use a ⅜" thick SuperStrongPlate 104 with outer dimensions of 7.5×15 inches. The example SuperStrongBolts 105 are ½ diameter×8½ inches long, 13 threads. This bolt 105 has a clamping capacity of about 13,000 pounds. The two bolts 105 together provide about 13 tons of Post-Tensioning. National Fine threads would be about 10% stronger, and of course larger bolts 105 could certainly be used for even more Unitized Post-Tensioning.

In FIG. 5 C, the SuperStrongPlate 104 is shown. The through hole 106 and the threaded aperture 107 is also displayed. For coordinating and placing the plates 104 onto the configurations 101, alignment demarcations 114 are shown. The method of use is described below. FIG. 5 D shows several SuperStrongBolts 105. FIG. 5 E is a sketch of a super bolt 105 which has at one end a means to turn 108 and at the opposite end a tapered thread 109. The taper 109 permits and improves the assembly process by locating the through bolt 105 into the threaded aperture 107.

Protecting SuperStrong plates 104 and bolts 105 from the elements may be important. The Bolt-A-Blok standard bars, turning bars, and bolts are normally protected from the elements by being contained within the wall or structure. In the SuperStrong Blok assembly 101A, the plates 104 and bolts 105 may be exposed to the elements and may need to be protected from rusting and other corrosion. There are several ways to protect the bolts 105 and plates 104. For example, the bolts 105 may be zinc chromated (preferred). The plates 104 can be zinc chromated, galvanized, or painted with one of more than a hundred rust inhibiting paints. Another choice may be to use self limiting rusting steel such as Cor-Ten™, manufactured by US Steel. One skilled in the art of plates and fasteners well appreciates that stainless steel or high strength composite materials could be used for the bolts and plates. Finally, in FIG. 5 F, a simple impact test using a Sledge Hammer or impact testing means 110 is demonstrated. The SUPER UPT BLOCK SYSTEM 101 resists the effects of the block 102 fragmenting from detonation or explosions near or at the surface of the face of the block 102.

FIG. 6 are various configurations of the new SUPER UPT BLOCK SYSTEM 101 with the post tensioned reinforcement and super heavy duty strength capabilities. Typical block patterns may be: horizontal running bond, vertical running bond, stack bond, soldiers course bond, and herringbone both horizontal and vertical. In FIG. 6 A a Stack Bond 111 is shown with the block 102 and the plates 104. In FIG. 6 B a SuperStrongBlok bridge assembly or horizontal stack assembly 111A is demonstrated. The blocks 102 are bolted together with tons of pressure. At the same time, the blocks 102 are being post-tensioned by the plates 104 and bolts 105, further increasing the strength of the block. The blocks are bolted together into one solid mass of concrete and steel—becoming essentially a monolith. The wall is instantly at full strength since there is no "wait" time for the mortar (block and mortar) or concrete (reinforced cast in place concrete) to cure. It may be manufactured so that typical concrete block strength is twice the strength of cast in place, reinforced concrete. FIG. 6 C shows a Running Bond 112. For these types of pier and wall configurations, the structure can have any thicknesses and can be built in all three directional planes. Any configuration may have pockets or recesses of any desired shape. The configurations can include beams, columns and cantilevered structures as desired for a plethora of applications in various structures in building and construction. The three dimensional variations is exemplified in the random configuration 113 in FIG. 6 D.

FIGS. 7 A through 7 D show the details of the main plate or anchor device 104 complete with location markings 114 for ease and speed of assembly. Also shown are the through holes 106 and threaded holes 107 for each plate 104. Of note is that the plates 104 are in a perfect, multiple ratio of 2 to 1 (width to length). This is a precise and calculated ratio to coordinate and complement the block ratios of 1:1:2 as for width:height: and length. Note here that the half blocks 102B are 1:1:1 ratios to supplement the assembly configuration and process. As shown in the Figures below, the demarcations (color 114 or geometric 114B) are aligned, and the entire structure 101 fits and aligns properly. Whether using the geometric 114B or color coded 114, the alignment demarcations provide a significant alignment method for the SUPER UPT BLOCK SYSTEM 101.

Each preferred plate has four holes (106,107) for tendons, in a special 45 degree angle pattern. All holes must be in correct alignment for connecting and also to attain Unitized Post Tensioning. The hole configurations are designed so that connecting and aligning can be achieved by positioning the plate in any of 8 positions (FIGS. 8 and 9). Since the pattern and system is complex, a person assembling the system would have difficulty assembling the plates in proper order. Therefore the SUPER UPT BLOCK SYSTEM 101 includes flail specially conceived and developed demarcations 114, 114B that makes it immediately apparent how to assemble the plate pattern and layout. This color coded system is apparent in the drawings.

FIGS. 8 A through 8 C are sketches of the grid alignment provided by the delineated and specially marked plates or anchors in the SUPER UPT BLOCK SYSTEM 101. The plates have specific colored marks 114 and/or geometric marks 114B that permit the plates 104 to be placed precisely and quickly on the blocks 102 of the SUPER UPT BLOCK SYSTEM 101. The aligned plates 115 create a carpet of steel plates wherein the Carpet colors match for perfect hole 106, 107 alignments. The though holes 106 and the threaded holes 107 are on a perfect 45 degree position and each set is opposite of the adjacent set (see the illustration). The Carpet connector pattern, angle holes (4 holes—2 threaded, 2 smooth) Half plates 102B, etc. permit the configuration shown in FIG. 8. In the operation discussion below, the FIG. 9 is described for the match-up grid 115. The individual configurations 116-1 through 116-8 show the various angular positions afforded by the special demarked 114 plates 104 on the alignment grid 115.

FIGS. 10 A through 10 E provide prototype sketches of the SUPER UPT BLOCK SYSTEM 101 with the strength plates 104 in various horizontal configurations. In these sketches, on should note the plate 104 patterns and markings 114. The high strength bolts 105 of the SUPER UPT BLOCK SYSTEM 101 are designed to connect it all together with high strength and post tensioning. These figures are various views looking down on a pier or base configuration of the SUPER UPT BLOCK SYSTEM 101 with the plates 104 in a horizontal position. The various views show the interconnection of full SUPER UPT BLOCK SYSTEM 101 and half block assemblies 101B to complete the configurations. One also notes how in each case for each layer of the contiguous block, the demarcations 114 on the plates 104 "match-up" to the contiguous plate of the system.

Added explanations for the Block and Plate patterns shown in FIGS. 10 A through 10 E include the description of the three level pier with SuperStrongBloks. A hand wrench, an air impact wrench or a battery powered impact wrench could be used for assembly. The plates and blocks can be placed in any direction. The demarked 114 plates are designed to fit together in a "carpet" (horizontal) or "wallpaper (vertical) configuration or shape. The patterns of the blocks and the patterns of each layer or level of the steel do not have to be concurrent. In fact, for highest strength, the patterns should be different for different layers.

FIG. 10 F is a sketch of the SUPER UPT BLOCK SYSTEM 101 used for a sign post or similar installations. The block system 101 is built in a configuration to leave an aperture or opening 117 interior to the total configuration. This permits a structural member 133 to be placed interior and secured by some means such as grout or concrete. The grout would be fast drying and high strength to permit immediate use of the sign post or other such device.

FIGS. 11 A through 11 E provide prototype sketches of the SUPER UPT BLOCK SYSTEM with the strength plates in various vertical configurations. In these sketches, the wall configurations have the vertical plates 127. Plates and blocks can be placed in any direction. A single block thickness of a wall with vertical plates contains ¾ inches of steel plus a SuperStrongBlok. In this configuration the steel may easily be positioned to limit flying debris from an explosive event and also to limit damage in the event of a light arms fire strike. This configuration limits fragmentation of the materials and protects nearby personnel, materials or equipment.

FIGS. 12, 13 and 14 show applications of the SUPER UPT BLOCK SYSTEM 101 and are described in the operations, below.

FIGS. 15 A through 15 E show various auxiliary connection means and auxiliary block configurations for the SUPER UPT BLOCK SYSTEM 101. In FIGS. 15 A and 15 C, full block systems 101 and half block systems 101B have blocks that are molded and cast with right angle holes 103A and 103B so bolts go two ways. This permits horizontal and vertical sections of SUPER UPT BLOCK SYSTEM 101 to be fastened to each other and for configurations to "change planes". A Section View FIG. 15B shows the two ducts 103A and 103B in the same block. While this will take special manufacturing techniques and possibly secondary operations, this configuration with perpendicular ducts is anticipated. In FIGS. 15 D and 15 E, more traditional joining methods are shown. The horizontal plates 116 and vertical plates 127 are on typical SUPER UPT BLOCK SYSTEMS 101. Full plates (116, 127) may be fastened together or configured as a full coverage L-shaped plate 130 or shorter legged L-shaped plates 131 for joining the horizontal and vertical members of the SUPER UPT BLOCK SYSTEMS 101. Likewise FIG. 15 E demonstrates that full plates 116 and 127 might be configured into full T-shaped plates 128 or shorter legged T-shaped plates 129 for joining the horizontal and vertical members of the SUPER UPT BLOCK SYSTEMS 101.

FIG. 16 shows a transition and comparison sketch for various shelters over the ages. In the chart 124, the various types of shelters and buildings are compared. The high strength SUPER UPT BLOCK SYSTEMS 101 show the marked change and superiority over the tents, wood, block and even reinforced concrete systems. The reinforced system is overcome since the SUPER UPT BLOCK SYSTEMS 101 utilized unitized post tensioning of a steel network and predictable, controllable batches of concrete when the blocks are produced. The additional steel and concrete combined also is superior to pre-cast walls (not shown in the table) due to the steel reinforcing web. Plus, the SUPER UPT BLOCK SYSTEMS 101 need not have special lifting equipment required for setting pre-cast configurations. The SUPER UPT BLOCK SYSTEMS 101 can be done one unit at a time. One skilled in the art knows that obviously, if desired, the SUPER UPT BLOCK SYSTEMS 101 can conceivably be made in large sections and then transported and set in place similar to precast.

FIG. 17 shows a comparison table 125 of features and functions for various building systems used in modern times. The chart is self explanatory and easy to empirically confirm. However, a skilled building or structural engineer realizes that benefits of the features and functionality of the SUPER UPT BLOCK SYSTEMS 101 over other systems is also largely intuitive.

For the overall SUPER UPT BLOCK SYSTEMS 101, there are several ways to strengthen the SuperStrongBloks or Military blocks. One skilled in construction techniques appreciates that tendons (bolts) 105 could be added. This would mean that additional apertures 106, 107 would be needed in the plates 104. For the plates 104, one could specify and use cold roll or other stronger alloys. For the bolt 105 and plate 104 connection, the threaded connection might be with SAE Nat'l Fine threads to add for example as much as 10% strength or weld a nut on the plate for added strength or even specify thicker plates. A slightly smaller block core 103 is possible. And as one versed in concrete appreciates, use of stronger concrete mix (aggregate type and cement concentration) will result in a stronger system.

For the overall SUPER UPT BLOCK SYSTEMS 101, there are also several materials and featured structural configurations that may feasibly be used to manufacture the plates/anchors 104 and the bolt/tendons 105. Various metals, alloys, composite materials and the like are being improved and invented on a continual basis. Various fasteners and connection devices and means may be use to interconnect the SUPER UPT BLOCK SYSTEMS 101. Clearly the preferred embodiment is the steel plates 104 and threaded bolt 105 for the anchors and tendons. However, alternative materials and means to connect are within the scope and spirit demonstrated herein for the SUPER UPT BLOCK SYSTEMS 101.

The details mentioned here are exemplary and not limiting. SUPER UPT BLOCK SYSTEMS 101 may have SuperStrongBloks that are made in various sizes and thicknesses. Any desired combination, shape or pattern can be assembled. Also well appreciated by one skilled in the art of construction materials, all the examples of the materials may be substituted with other plastics and composite materials that have similar properties and still be within the scope and spirit of this SUPER UPT BLOCK SYSTEM 101. Other components specific to describing a SUPER UPT BLOCK SYSTEM 101 may be added by a person having ordinary skill in the field of construction as being obvious from the above described embodiment.

Operation of the Preferred Embodiment

The new SUPER UPT BLOCK SYSTEM 101 has been described in the above embodiment. The manner of how the device operates is described below. One notes well that the description above and the operation described here must be taken together to fully illustrate the concept of the SUPER UPT BLOCK SYSTEM 101.

FIGS. 7, 8 and 9 are further details of the grid alignment plates 115 for the SUPER UPT BLOCK SYSTEM 101. FIG. 7 shows the plates have specific colored marks 114 and/or geometric marks 114B that permit the plates 104 to be placed precisely and quickly on the blocks 102 of the SUPER UPT BLOCK SYSTEM 101. The various alignments are shown in FIGS. 8 and 9 by the sketches 116-1 though 116-8. These eight (8) configurations coupled with the demarcations 114, permit one to build quickly and precisely since the hole alignment with the threads, of the bolt 105 into the plates 104 are "automatically provided". FIG. 9 is a group of sketches that further details the match-up grid 115 alignment of the plates for the SUPER UPT BLOCK SYSTEM 101. The individual configurations 116-1 through 116-8 show the various angular positions afforded by the special demarked 114 plates 104 on the alignment grid 115. The aligned plates 115 create a "carpet of steel plates" wherein the carpet colors match for perfect hole 106, 107 alignment. The through holes 106 and the threaded holes 107 are on a perfect 45 degree position and each set is opposite of the adjacent set (see the illustration). The carpet connector pattern, angle holes (4 holes—2 threaded, 2 smooth), half plates 102B, etc. permit the configurations shown in FIGS. 10 A through 10 E prototype sketches of the SUPER UPT BLOCK SYSTEM 101. This same match-up system permits the SUPER UPT BLOCK SYSTEM 101 to be configured in an operation with vertical plates 104. These configurations are shown in FIGS. 11 A through 11 E prototype sketches of the SUPER UPT BLOCK SYSTEM with the strength plates in various vertical configurations.

FIG. 12 shows sketches of various examples of the SUPER UPT BLOCK SYSTEM 101 in protective or strong wall configurations. A standard configuration is a running bond 101A. A soldier bond 118 stacks the block vertically but the plates 104 may be used to easily tie the contiguous blocks together. Dual running walls 119 may be configured with the single walls 101A contiguous and virtually touching. These same single walls 101A may be separated and have end walls 120. This configuration may be left open interiorly or filled with material 126. Multiple walls 121 would include two or more single walls 101A. These might be built along a specified perimeter or even along a boundary or border. These "plurality" of walls are separated by an open area. FIGS. 13 and 14 show additional operation.

FIGS. 13 A through 13 F show sketches of various reinforced columns and beams in typical structural systems which are potential applications for the SUPER UPT BLOCK SYSTEM. In FIGS. 13 A and 13 B, a horizontal beam structure 122, such as for bridges, over passes and the like, is supported by a vertical column structure 123. FIGS. 13 C through 13 F show beams and columns that have deteriorated through corrosion or other outside forces. The deteriorated beam structures 122A and the deteriorated columns 123A pose undefined risks since the extent of deterioration and remaining structural strength is unknown. This causes original designs to have higher safety factors built-in. This drives construction costs higher due to added materials, labor and time. Structures 122A and 122B are often condemned and removed due to the unknown structural condition and fear for public safety. SUPER UPT BLOCK SYSTEMS 101 can help address this as shown below.

FIGS. 14 A through 14 C show sketches of columns and beams for both new structures and examples of retrofitting deteriorating or damaged structures, as just described above, with the SUPER UPT BLOCK SYSTEM 101. The SUPER UPT BLOCK SYSTEM provides great support for a new or retrofitted structure. To support the weight of a dam, pier, or building, the weight must be spread over a large area. The SUPER UPT BLOCK SYSTEM is specially designed with a completely level and flat bottom. In addition, all blocks are locked together to essentially form a monolith. As an example, the prototype SuperStrongBlok has 120 square inches of flat surface—nearly a square foot. To continue an example, for soil that is load-rated at 4,000 pounds for each square foot, then each SuperStrongBlok would support 3,333 pounds of weight (4000×83%). If the structure's base had 300 SuperStrongBloks, then the structure would support one million pounds, which is 500 Tons. This example shows that the load bearing capacity of SUPER UPT BLOCK SYSTEMS 101 with SuperStrongBloks is extremely high.

Specifically in FIGS. 14 A through 14 C there are examples of uses for the new and retrofitted columns and beams. FIG. 14 A shows a small cross-section of a SUPER UPT BLOCK SYSTEM 101 that uses one and one-half blocks per side. This smaller column 137A,139A has a center that is either open [column 137A](the opening may be for a chase or other uses) or filled [column 139A], with block or other material 138. The SUPER UPT BLOCK SYSTEM 101 is still used as the base system and method of construction. The top structure might be another SUPER UPT BLOCK SYSTEM such as a soldier stack 140 or other horizontal structural members supported by the column 137A, 139A. FIG. 14 B shows a larger cross-section of a SUPER UPT BLOCK SYSTEM 101 that uses a plurality of blocks per side. This column 137,139 has a center that is either open [column 137](the opening may be for other structural members, a chase or other fillings 138 uses) or block filled [column 139]. The SUPER UPT BLOCK SYSTEM 101 is still used as the base system and method of larger structures in construction. The top structure might be another SUPER UPT BLOCK SYSTEM such as a horizontal structural beam or the like supported by the column 137,139. FIG. 14 C shows a simple retrofit of a deteriorated column 134 with a surrounding configuration by the SUPER UPT BLOCK SYSTEM 101. Here the SUPER UPT BLOCK SYSTEM encircles the deteriorated member 134 and gives new strength to the overall structure. Near the horizontal beam or structure 135 there would be a means to connect or support from the new, revitalized vertical structure to the horizontal structure 135. There are many means to interconnect or have a movable (rolling, sliding, or the like) support from the retrofitted vertical structure and the horizontal structure being supported. Each application may be very specific to the retrofitted structure, yet the use of the SUPER UPT BLOCK SYSTEM still applies.

TABLE D

A FEW EXAMPLES OF SPECIAL USES for SUPER UPT BLOCK SYSTEMS - as New or Retrofit Construction

| ITEM | DESCRIPTION |
|---|---|
| 1 | piers |
| 2 | dams |
| 3 | floors |
| 4 | walls |
| 5 | double walls |
| 6 | levees |
| 7 | tower bases |
| 8 | barricades |
| 9 | vehicle control points |
| 10 | anti-terror barricades at public buildings |
| 11 | armories |
| 12 | bridge piers |
| 13 | border patrol facilities |
| 14 | protection of cargo and flammable tanks |
| 15 | buildings that need to be quickly moved |
| 17 | Safe rooms |
| 18 | Retaining walls |
| 19 | Earthquake and/or hurricane prevention |
| 20 | Structural columns and beams |
| 21 | |

With this description of the detailed parts and operation it is to be understood that the SUPER UPT BLOCK SYSTEM 101 is not to be limited to the disclosed embodiment. The features of the SUPER UPT BLOCK SYSTEM 101 are intended to cover various modifications and equivalent arrangements included within the spirit and scope of the description.

What is claimed is:

1. An assembly, comprising:

first, second and third respective parallel, stacked anchor plates, each respective plate having a respective first aperture and a respective second threaded aperture;

a first concrete block disposed between the first and second anchor plates;

a second concrete block disposed between the second and third anchor plates;

a first post extending through the first concrete block and engaged to the respective first aperture in the first anchor plate and threadedly engaged with the respective second threaded aperture in the anchor second plate;

a second post extending through the second concrete block and engaged to the respective first aperture in the anchor second plate and threadedly engaged with the respective second threaded aperture in the anchor third plate;

wherein threaded engagement of the first post with the respective second threaded in the first plate aperture exerts a tensile force on the first post and a compressive force on the first concrete block;

wherein threaded engagement of the second post with the respective second threaded aperture in the second plate exerts a tensile force on the second post and a compressive force on the second concrete block;

wherein the second anchor plate is compressively connected to the first and second blocks;

wherein a line passing through a respective first and second aperture intersects a side of the anchor plate at a 45 degree angle; and wherein each anchor plate further includes demarcations commensurate with the orientation of each respective first and second aperture.

2. A high strength masonry structure comprising:

a plurality of respective masonry units, each respective unit having parallel top and bottom planar surfaces defining a standard distance therebetween, and first and second respective cavities, each respective cavity extending from the top to the bottom surface;

a plurality of respective anchor plates, each respective anchor plate having a first and a second pair of apertures, each respective pair of apertures including a respective nonthreaded aperture and a respective threaded aperture, and each respective anchor plate positioned adjacent a respective top planar surface, wherein a respective first set of apertures is aligned with a respective first through-cavity and a respective second set of apertures is aligned with a respective second through-cavity;

a plurality of respective tensioning posts, each respective tensioning post having a respective head portion at a respective top end and a respective threaded portion at a respective bottom end and defining a post length therebetween, wherein the post length is greater than one standard distance but less than two standard distances;

wherein each respective post extends through a first respective anchor plate, a through cavity, and a second respective anchor plate, with the respective head portion engaging the first respective anchor plate at an unthreaded aperture and the respective threaded portion threadedly engaging the second respective anchor plate at a threaded aperture to define an engaged post;

wherein each respective masonry unit is operationally connected to at least one other respective masonry unit by at least one respective anchor plate;

wherein each respective threadedly engaged post applies a compressive force to a respective masonry unit to define a respective compressed masonry unit;

wherein each respective compressed masonry unit is operationally connected to at least one other compressed respective masonry unit by at least one respective anchor plate;

wherein the respective operationally connected compressed masonry units define a post tensioned structure;

wherein a first line passing through a respective pair of apertures intersects a side of the anchor plate at a 45 degree angle;

wherein the each respective first pair of apertures enjoys an orientation that is reversed relative to each respective second pair of apertures;

wherein a second line passing through the respective second pair of apertures would be orthogonal to the first line; and wherein each anchor plate further includes demarcations commensurate with the orientation of each respective first and second pair of apertures.

* * * * *